US006902858B2

(12) United States Patent
Mochizuki et al.

(10) Patent No.: US 6,902,858 B2
(45) Date of Patent: Jun. 7, 2005

(54) IMAGE FORMATION APPARATUS USING A DRY TWO-COMPONENT DEVELOPER FOR DEVELOPMENT

(75) Inventors: Satoshi Mochizuki, Shizuoka (JP); Naohito Shimota, Shizuoka (JP); Hiroaki Matsuda, Shizuoka (JP); Shinichiro Yagi, Shizuoka (JP); Tomomi Tamura, Shizuoka (JP); Tatsuya Niimi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 10/804,063

(22) Filed: Mar. 19, 2004

(65) Prior Publication Data

US 2004/0179861 A1 Sep. 16, 2004

Related U.S. Application Data

(63) Continuation of application No. 10/020,925, filed on Dec. 19, 2001, now Pat. No. 6,757,507.

(30) Foreign Application Priority Data

Dec. 20, 2000 (JP) ..... 2000-387939
Dec. 13, 2001 (JP) ..... 2001-380525

(51) Int. Cl.[7] ..... G03G 15/09

(52) U.S. Cl. ..... 430/159; 430/267; 430/274; 430/56

(58) Field of Search ..... 399/159, 267, 399/274; 430/56

(56) References Cited

U.S. PATENT DOCUMENTS

| | | | |
|---|---|---|---|
| 4,762,763 | A | 8/1988 | Nomura et al. |
| 4,933,250 | A | 6/1990 | Nakayama et al. |
| 4,950,573 | A | 8/1990 | Yamaguchi et al. |
| 4,980,258 | A | 12/1990 | Aoki et al. |
| 5,028,502 | A | 7/1991 | Yuh et al. |
| 5,100,453 | A | 3/1992 | Richards |
| 5,168,028 | A | 12/1992 | Nanya et al. |
| 5,288,577 | A | 2/1994 | Yamaguchi et al. |
| 5,344,732 | A | 9/1994 | Chiba et al. |
| 5,368,972 | A | 11/1994 | Yamashita et al. |
| 5,403,690 | A | 4/1995 | Kuramoto et al. |
| 5,429,901 | A | 7/1995 | Muto et al. |
| 5,547,790 | A | 8/1996 | Umeda et al. |
| 5,554,478 | A | 9/1996 | Kuramoto et al. |
| 5,677,094 | A | 10/1997 | Umeda et al. |
| 5,721,083 | A | 2/1998 | Masuda et al. |
| 5,771,426 | A | 6/1998 | Oka et al. |
| 5,789,128 | A | 8/1998 | Adachi et al. |
| 5,804,343 | A | 9/1998 | Umeda et al. |
| 5,834,145 | A | 11/1998 | Yoshinaga et al. |
| 5,840,456 | A | 11/1998 | Tomita et al. |
| 5,846,680 | A | 12/1998 | Adachi et al. |
| 5,853,935 | A | 12/1998 | Suzuki et al. |
| 5,871,876 | A | 2/1999 | Ikuno et al. |
| 5,879,849 | A | 3/1999 | Sawada et al. |
| 5,882,832 | A | 3/1999 | Tosaka et al. |
| 5,910,561 | A | 6/1999 | Adachi et al. |
| 5,928,828 | A | 7/1999 | Suzuki |
| 5,942,363 | A | 8/1999 | Tanaka et al. |
| 5,999,773 | A | 12/1999 | Yasutomi et al. |
| 6,004,715 | A | 12/1999 | Suzuki et al. |
| 6,010,814 | A | 1/2000 | Kotsugai et al. |
| 6,026,262 | A | 2/2000 | Kinoshita et al. |
| 6,030,736 | A | 2/2000 | Ikegami et al. |
| 6,069,224 | A | 5/2000 | Adachi et al. |
| 6,074,794 | A | 6/2000 | Fushimi et al. |
| 6,074,795 | A | 6/2000 | Watanabe et al. |
| 6,087,055 | A | 7/2000 | Niimi |
| 6,103,441 | A | 8/2000 | Tomita et al. |
| 6,132,911 | A | 10/2000 | Niimi |
| 6,136,483 | A | 10/2000 | Suzuki et al. |
| 6,180,298 | B1 | 1/2001 | Kuroda et al. |
| 6,183,926 | B1 | 2/2001 | Kuroda et al. |
| 6,191,249 | B1 | 2/2001 | Tanaka et al. |
| 6,218,533 | B1 | 4/2001 | Niimi |
| 6,228,550 | B1 | 5/2001 | Matsuda et al. |
| 6,249,304 | B1 | 6/2001 | Sawayama et al. |
| 6,258,502 | B1 | 7/2001 | Nakamura et al. |
| 6,303,257 | B1 | 10/2001 | Hasegawa et al. |
| 6,303,258 | B1 | 10/2001 | Katoh et al. |
| 6,322,940 | B1 | 11/2001 | Nishigaki et al. |
| 6,326,112 | B1 | 12/2001 | Tamura et al. |
| 6,360,068 | B1 | 3/2002 | Kinoshita et al. |
| 6,363,229 | B1 | 3/2002 | Shiraishi et al. |
| 6,366,751 | B1 | 4/2002 | Shakuto et al. |
| 6,395,443 | B2 | 5/2002 | Kuroda et al. |
| 6,406,826 | B1 | 6/2002 | Suzuki et al. |
| 6,432,589 | B1 | 8/2002 | Uchinokura et al. |
| 6,432,596 | B2 | 8/2002 | Ikuno et al. |
| 6,444,387 | B2 | 9/2002 | Ri et al. |
| 6,447,968 | B1 * | 9/2002 | Ohno ..... 430/106.2 |
| 6,468,706 | B2 | 10/2002 | Matsuda et al. |
| 6,757,507 | B2 * | 6/2004 | Mochizuki et al. ..... 399/159 |

FOREIGN PATENT DOCUMENTS

| | | |
|---|---|---|
| JP | 52-36016 | 3/1977 |
| JP | 52-38016 | 3/1977 |
| JP | 64-12386 | 2/1989 |
| JP | 3-109406 | 5/1991 |
| JP | 5-19632 | 1/1993 |
| JP | 2000-206723 | 7/2000 |
| JP | 2001-34001 | 2/2001 |
| JP | 5-19632 | 1/2003 |

* cited by examiner

*Primary Examiner*—John L Goodrow
(74) *Attorney, Agent, or Firm*—Oblon, Spivak, McClelland, Maier & Neustadt, P.C.

(57) ABSTRACT

An image formation apparatus develops an electrostatic latent image with a two-component developer consisting of magnetic carriers and toners by using a development apparatus and a latent image supporter including a filler in an outermost layer thereof, the development apparatus having a developer supporter, which has an internally fixed magnetic body and rotates while supporting a developer on a surface thereof, and a developer quantity controller controlling a quantity of the developer which is supported by the developer supporter facing the magnetic body and controlling a height of magnetic brushes and consisting of materials having rigidity or rigidity and magnetic properties, wherein a ratio (Gp/Gd) of a development gap to a doctor gap between the developer supporter and the controller is from 0.7 to 1.0, and a weight-averaged particle diameter of a developer carrier is from 20 to 60 $\mu$m.

15 Claims, 4 Drawing Sheets

IMAGE FORMATION APPARATUS USING A DRY TWO-COMPONENT DEVELOPER FOR DEVELOPMENT

This application is a continuation of application Ser. No. 10/020,925 filed Dec. 19, 2001 now U.S. Pat. No. 6,757,507.

BACKGROUND OF THE INVENTION

1. Field of the Invention

The present invention relates to an electro-photographic apparatus, and more particularly, to a method and apparatus for development using a dry two-component developer.

2. Description of the Related Art

Conventionally, a magnetic brush development method using a two-component developer consisting of magnetic carriers and toners has been employed in an electro-photographic apparatus. A development apparatus using the method normally has a magnet roller having a magnetic body including a plurality of magnetic poles and a development sleeve which is a rotatably supported cylindrical developer supporter. The development apparatus develops by holding magnetic carriers having toners on a surface of the development sleeve and carrying them to a development area. On the other hand, a one-component development method in which development is performed by using only magnetic toners or non-magnetic toners without magnetic carriers has also been employed. The one-component development method is similar to the two-component development method in respect to development by holding toners on a surface of a development sleeve and carrying them to a development area, but different from it with respect to detailed structures and a means of charging toners, etc.

In such a development apparatus, it has been proposed to improve image quality by improving of toner carrying performance by increasing surface roughness of a development sleeve using a one-component development method as described in Japanese Examined Application Publication No. 64-12386. A method to improve performance of carrying toners by increasing surface roughness of a development sleeve using a two-component development method has also been proposed as described in Japanese Laid-Open Patent Application No. 5-19632.

However, the methods described above presuppose non-contact development and that the quantity of developer on a developer supporter is controlled to be constant by using a developer quantity controller in the form of a bar. A non-contact development method using a developer quantity controller which is made from materials having rigidity or rigidity and magnetic properties have problems in providing enough developer on a developer supporter. Especially, size of carrier particles needs to be smaller to meet recent requirement for high image quality and downsizing. However, when size of carrier particles is made smaller, fluidity of the particles tends to be lower, so that the above mentioned method has problems in carrying developer to a development area uniformly when such a developer is used.

Furthermore, in most recent copying machines, a photo conductor and a development apparatus are combined and they can be easily exchanged, providing for labor savings related to maintenance by a service person. In such a system, since cost is higher if an exchanging cycle is short, a developer having a long service life and a latent image supporter having a service life comparable to the one of the developer, which is referred to below as a photo conductor, are required. However, when the two-component contact development method is employed, a photo conductor is always rubbed with developer, and, thus, it is easy for the photo conductor to become worn and difficult to have a long servicelife. Furthermore, density of a developer on a development area is required to be high to meet the demand for high image quality. However, if density of a developer on a development area is high, wear of the photo conductor is accelerated. In order to prevent wear of the photo conductor, prevention of wear by decreasing printing resistance has been attempted by adding a filler to the outermost layer of a photo conductor. Ozone generating from a charger and low resistance materials secondarily produced from nitrogen oxides fall on an outermost layer of a photo conductor and adhere to a surface of the layer. When a photo conductor in which a filler is not added to the outermost layer is used, abrasion of the outermost layer of a photo conductor is reduced and resistance of a surface of a photo conductor is reduced by adhesion of the low resistant materials, so that abnormal images having decrease in resolution or blur are not formed. The problem originates when wearing rate of the outermost layer is faster than the deposition rate of the low resistance materials. However, the abrasion loss of a photo conductor defines the service life of the photo conductor. On the other hand, when a layer having high wear resistance is laid on the outermost layer of a photo conductor as in the subject application, abrasion loss decreases and the service life of a photo conductor is not controlled by the wear resistance. However the deposition rate of the low resistance materials produced from ozone and nitrogen oxides, etc., described above overcomes the rate of wear resulting in deposition (adhesion) of the low resistance materials to the surface of the photo conductor. Gonsequently, side effects such as decrease in resolution and blur in an image resulting from decrease of resistance on a surface of a photo conductor are generated, therefore a new problem of the side effects controlling the service life of an image formation apparatus occurs.

When a layer including a filler is laid on the outermost layer of the above mentioned photo conductor, the wear resistance is improved, but side effects may occur. When a conductive filler is employed as a filler, resistance on a surface of a photo conductor is reduced, and decrease in resolution and blur in an image may occur due to a reason other than the above mentioned phenomenon. Especially, the phenomenon is significant when a photosensitive layer is made from an organic material. Therefore, it is necessary to employ a high resistance filler in an organic photo conductor. In this case, since the filler does not have charge transfer efficiency, when the photo conductor is repeatedly used in an electro-photographic apparatus, residual potential is elevated or electric potential of exposed areas is elevated in negative or positive development, so that there is produced a defect of decrease in image density.

Thus, as wear resistance of a photo conductor is improved and abrasion loss does not define the service life of a photo conductor, an electrostatic service life of the photo conductor defines the service life of the photo conductor. Specifically, point defects (stains and black points, etc.) on image background (white background), which are not in an original image, occur due to decreasing electrostatic property of a photo conductor (especially, local leak of electric potential). The defects may be taken for points in a drawing or period and comma, etc., in a draft in English so that the defects are crucial in an image.

SUMMARY OF THE INVENTION

The present invention is achieved in the situation as described above. It is a general object of the present invention to provide an image formation apparatus preventing deposition of low resistance materials produced from ozone and nitrogen oxides on a surface layer of an improved wear-resistant photo conductor by providing a developer with moderate strength to the photo conductor and thereby prevent the generation of an abnormal image having blur and decrease in resolution, which is peculiar to a high wear resistant photo conductor.

A more specific object of the present invention is to provide an image formation apparatus preventing elevation of residual potential caused by repeated use of a photo conductor including a filler in an outermost layer and preventing decrease of image density in negative or positive development.

A further specific object of the present invention is to provide an image formation apparatus preventing a reduction of electrostatic properties caused by repeated use of a photo conductor and preventing point defects (stains on image background) in negative or positive development.

The inventors actively investigated the relation among developer carrying properties, diameters of developer particles and surface roughness Rz of a development sleeve in order to solve the above mentioned problems. As a result, the inventors found that when a developer having the particle diameters within a particular range is used, the developer can be uniformly provided on a developer supporter by adjusting the relation between a development gap and a doctor gap to within a particular range, a surface of a photo conductor can be always maintained in usable condition by the developer, and there is no problem about the service life of the photo conductor.

That is, the solution of the above problem is achieved by the present inventions; (1) an image formation apparatus developing an electrostatic latent image with a two-component developer consisting of magnetic carriers and toners by using a development apparatus and a latent image supporter including a filler in an outermost layer thereof, the development apparatus having a developer supporter, which has an internally fixed magnetic body and rotates while supporting a developer on a surface thereof, and a developer quantity controller controlling a quantity of the developer which is supported by the developer supporter facing the magnetic body by controlling a height of magnetic brushes and consisting of materials having rigidity or rigidity and magnetic properties, characterized in that a ratio (Gp/Gd) of a development gap to a doctor gap between the developer supporter and a controller is from 0.7 to 1.0, and a weight-averaged particle diameter of a developer carrier is from 20 to 60 $\mu$m; (2) the image formation apparatus described in item (1) characterized in that surface roughness Rz of a development sleeve is from 10 to 30 $\mu$m; (3) the image formation apparatus described in the item (1) and (2) is characterized in that a surface of the development sleeve is processed by sand blasting; (4) the image formation apparatus described in any one of the items (1) to (3) is characterized in that a ratio (D/Rz) of the weight-averaged particle diameter (D) of the developer carrier to surface roughness (Rz) of the development sleeve satisfies a relation $2 \leqq D/Rz \leqq 3$; (5) the image formation apparatus described in items 1 to 4 is characterized in that the filler included in the outermost layer of the latent image supporter is formed by a metal oxide; (6) the image formation apparatus described in items 1 to 5 is characterized in that the outermost layer of the latent image supporter includes a charge transfer material; (7) the image formation apparatus described in item 6 is characterized in that the charge transfer material is a polymer having electron-donating groups; (8) the image formation apparatus described in items 1 to 7 is characterized in that the outermost layer of the latent image supporter includes an organic compound of which acid value is from 10 to 40 (mgKOH/g); (9) the image formation apparatus described in items 1 to 8 is characterized in that a charge generating material included in the latent image supporter is a titanylphthalocyanine having at least a maximum diffraction peak at 27.2° as diffraction peak at Bragg angle 2θ (±0.2°) for characteristic X-ray of CUKα; (10) the image formation apparatus described in items 1 to 8 is characterized in that the charge generating material included in the latent image supporter is an azo pigment represented by the following structural formula (A):

(A)

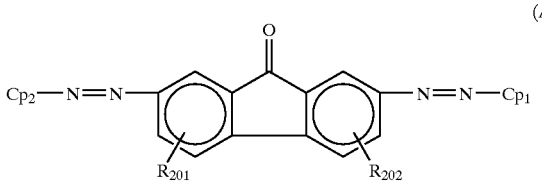

wherein $Cp_1$ and $CP_2$ are coupler residues, which are identical or different from each other; wherein $R_{201}$ and $R_{202}$ are respectively selected from a group consisting of hydrogen atom, halogen atom, alkyl groups containing 1 to 4 carbon atoms, alkoxy groups containing 1 to 4 carbon atoms, and cyano group and are identical or different from each other; wherein $Cp_1$ and $Cp_2$ are represented by the following structural formula (B):

(B)

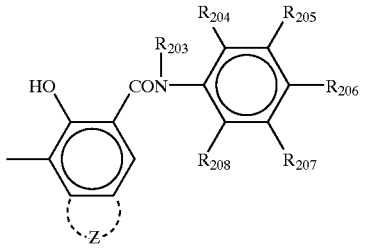

wherein $R_{203}$ is selected from a group consisting of hydrogen atom, alkyl groups such as methyl group and ethyl group, and aryl groups such as phenyl group; wherein $R_{204}$, $R_{205}$, $R_{206}$, $R_{207}$, and $R_{208}$ are respectively selected from a group consisting of hydrogen atom, nitro group, cyano group, halogen atom such as fluorine, chlorine, bromine, and iodine, trifluoromethyl group, alkyl groups such as methyl group and ethyl group, alkoxy groups such as methoxy group and ethoxy group, dialkylamino group, and hydroxyl group;

wherein Z represents an atom group required for forming a substituted or non-substituted aromatic carbon ring or a substituted or non-substituted aromatic heterocyclic ring;

(11) the electro-photographic apparatus described in items 1 to 10 is characterized in that a surface of a conductive supporter of the latent image supporter is anodized; (12) the electro-photographic apparatus described in items 1 to 11 is characterized in that in the electro-photographic apparatus, a charger contacts or is closely arranged to the latent image supporter; (13) the electro-photographic apparatus described in item 12 is characterized in that the size of air gap between the charger and the latent image supporter is equal to or less than 200 $\mu$m; (14) the electro-photographic apparatus described in items 12 and 13 is characterized in that in the electro-photographic apparatus, an alternating current component is superposed on a direct current component in the charger to provide a charge to the latent image supporter; (15) the electro-photographic apparatus described in items 1 to 14 is characterized in that zinc stearate is applied on the latent image supporter; (16) the electro-photographic apparatus described in item 15 is characterized in that in the electro-photographic apparatus, zinc stearate powder is included in the toner provided to a development area.

The development method according to the present invention is a two-component contact development method carried out by using a development apparatus having a developer supporter, which has an internally fixed magnetic body and rotates while supporting a developer on a surface thereof, and a developer quantity controller controlling a quantity of the developer which is supported by the developer supporter facing the magnetic body and consisting of materials having rigidity or rigidity and magnetic properties.

At first, the development apparatus according to the present invention will be illustrated. FIG. 1 shows a cross section of a development apparatus according to the present invention. In FIG. 1, it is shown that the reference numeral 1 is a photo conductor drum, 2 is a development sleeve housing, 3*a* is toner, 4 is a development sleeve, 5 is a magnet roller, 6 is a controller, 7 is a sleeve in front of a doctor, 7*a* is a diaphragm, 8 is a toner hopper, 8*a* is an aperture for supplying toners, 9 is a provision roller, 12 is a development area, A is a developer providing room, Gp is a development gap, and Gd is a doctor gap.

Herein, the photo conductor drum rotates in the direction indicated by the arrow, has the outermost layer including a filler on the surface of the photo conductor and forms an electrostatic latent image on the surface by a charger and an exposure device not shown in FIG. 1. The magnet roller 5 is fixed in the development sleeve being the developer supporter, has a plurality of (N), (S) magnet poles on the surface of the roller, supports the developer with the development sleeve, and carries the developer, in which the development sleeve 4 rotates in the same direction as the rotational direction of the photo conductor against the fixed magnet roller. The magnetic poles (N), (S) of the magnet roller 5 are magnetized to an appropriate magnetic flux density so that magnetic brushes consisting of the developer are formed by the magnetic force. The controller 6 controls the height and the quantity of the magnetic brushes. The distance between the controller and the development sleeve is referred to as doctor gap (Gd).

While the toner 3 provided into the apparatus is sufficiently stirred and mixed with the carriers by the provision roller 9 rotating in the direction indicated by the arrow and frictional electrification is carried out, the toner is carried to the development sleeve housing 2, and magnetic brushes of which the height and the quantity are controlled by the controller 6 are formed on the development sleeve 4. When the distance between the development sleeve 4 and the surface of the photo conductor drum 1, or development gap (Gp) is set to the predetermined distance (for example, 0.7 mm) and a electrostatic latent image is developed on the photo conductor drum, the magnetic brushes formed on the surface of the development sleeve 4 are vibrating due to a change of the magnetic flux density and moved with the development sleeve 4 while the development sleeve 4 rotates, and the magnetic brushes pass smoothly through a gap in the development area and a latent image is developed by the toner. In this case, a bias voltage may be preferably applied between the development sleeve 4 and the substrate of the photo conductor drum 1 in order to carry out the development.

The development method according to the present invention satisfies the condition that in the two-component development device shown in FIG. 1, the magnetic carriers of which the weight-averaged particle diameter is from 20 to 60 $\mu$m are utilized and a ratio (Gp/Gd) of the development gap (Gp) to the doctor gap (Gd) is from 0.7 to 1.0. If Gp/Gd is less than 0.7, adhesion of carriers is easily generated since a pool of the developer occurs in the development gap. On the other hand, if it is larger than 1.0, the developer is weakly applied to the photo conductor resulting in elimination of a cleaning effect. If the diameter of the carrier particle is less than 20 $\mu$m, it is not preferable since carrier adhesion easily occurs. If it is larger than 60 $\mu$m, although there is no notable trouble, it is not preferable due to a demand for high image quality. Also, surface roughness (Rz) of the surface of the development sleeve satisfies the condition of from 10 to 30 $\mu$m. Satisfaying the condition results in not only generating more cleaning effect but also stabilizing the providing of the developer, and is effective in improving image quality.

The surface roughness Rz means ten points-averaged roughness, and for example, it may be measured by Surfcoder SE-30H produced by Kosaka Laboratory. The ten points-averaged roughness reflects the depth of fine irregularities of a solid surface. Also, a material used in a development sleeve may be one used in a normal development apparatus, non-magnetic materials such as stainless steel, aluminum, and ceramics, and a coated development sleeve may be used but is not required. The form of the development sleeve is also not particularly limited.

In the present invention, in order to adjust the surface roughness Rz of the development sleeve to within the above mentioned range, although, for example, sand blasting, groove processing, grinding, sand paper, and index saver processing may be used, it is preferable to use sand blasting in respect to the following points. That is, since sand blasting is not only easy to operate and efficient to process but also can be used for a random surface processing (coarsening), frictional resistance between the toner and the development sleeve is considered to be improved equally in all directions.

It is effective for the ratio (D/Rz) of a weight-averaged particle diameter of a carrier (D) to surface roughness (Rz) of the development sleeve to satisfy a relation $2 \leqq D/Rz \leqq 3$, in order to improve the effect of the present invention. Even if the ratio does not satisfy the relation, there is no problem with respect to the cleaning effect of the photo conductor. However, if the ratio D/Rz is less than 2, stress applied on the carrier become larger and peeling off of carrier coating resin or carrier pollution with the toners easily occurs. On the other hand, if the ratio D/Rz is larger than 3, toner density becomes too high or a defect on carrying performance is generated a little when Q/M become too large.

BRIEF DESCRIPTION OF THE DRAWINGS

Other-objects, features and advantages of the present invention will become more apparent from the following detailed description when read in conjunction with the accompanying drawings, in which.

DETAILED DESCRIPTION OF THE PREFERRED EMBODIMENTS

Figure 1:
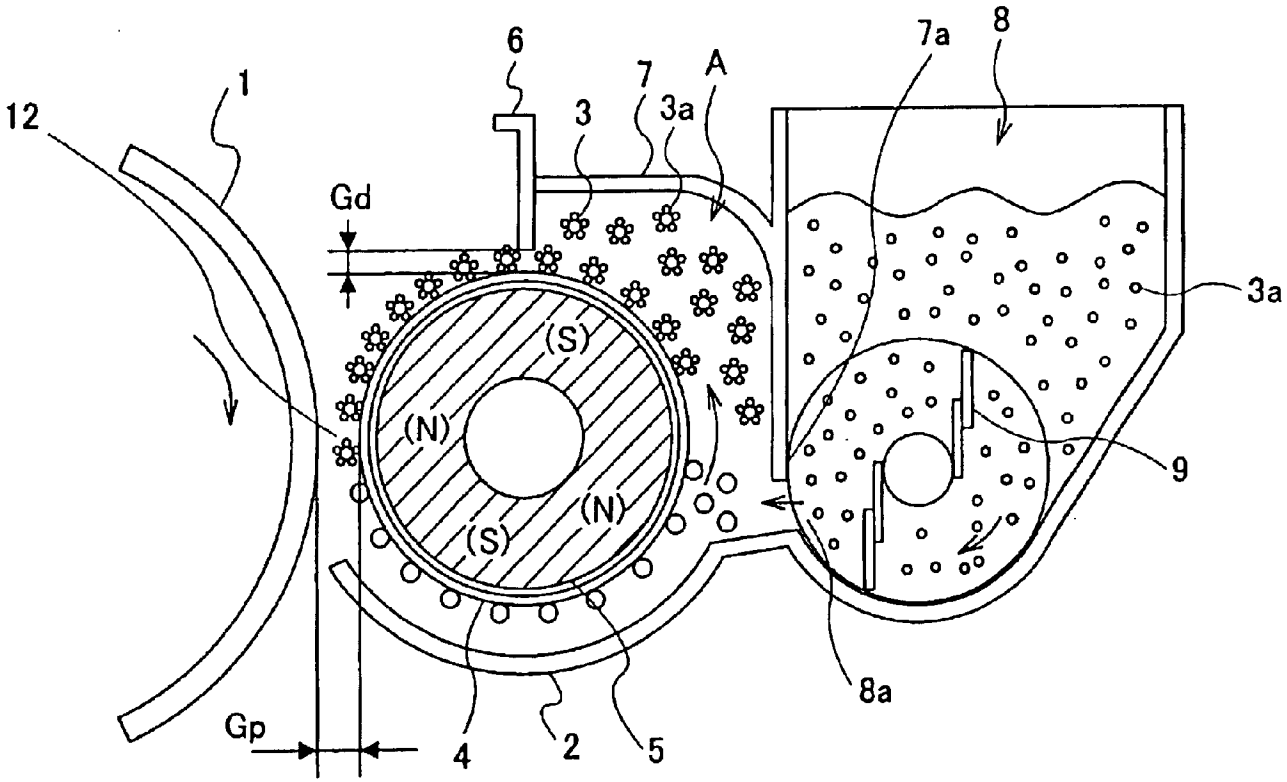
FIG. 1 shows a cross-section of a development apparatus used in the present invention.

The present invention will be illustrated by the embodiment described below.

Toners constituting developers with carriers for developing a latent image produced by conventional known method may be used according to the present invention. Specifically, after a mixture consisting of binder resin, a coloring agent, a polarity controlling agent and any other additives according to need is melted and kneaded by a thermal roll mill, the product is cooled and solidified, and the toners are obtained by pulverizing and classifying the product.

In this case, as for a binder resin, all well-known materials can be used. For example, a homopolymer of styrene or a substituted one thereof such as polystyrene, poly-p-styrene, polyvinyl toluene, a styrene-based copolymer such as copoly(styrene/chlorostyrene), copoly(styrene/propylene), copoly(styrene/vinyltoluene), copoly(styrene/methyl acrylate), copoly(styrene/ethyl acrylate), copoly(styrene/butyl acrylate), copoly(styrene/methyl methacrylate), copoly(styrene/ethyl methacrylate), copoly(styrene/butyl methacrylate), copoly(styrene/α-methyl chloromethacrylate), copoly(styrene/acrylonitrile), copoly (styrene/methyl vinyl ether), copoly(styrene/methyl vinyl ketone), copoly(styrene/butadiene), copoly(styrene/isoprene), copoly(styrene/maleic acid), and copoly(styrene/maleate), poly(methacrylate), polybutyl methacrylate, polyvinyl chloride, polyvinyl acetate, polyethylene, polypropylene, polyester, polyurethane, polyamide, epoxy resin, polyvinyl butyral, polyacrylate resin, rosin, modified rosin, terpene resin, phenol resin, aliphatic hydrocarbon resin, aromatic petroleum resin, chlorinated paraffin, and paraffin wax, etc. may be used independently or as a mixture thereof.

As for a polarity controlling agent, a conventionally known material can be used. For example, a metallic complex salt of azo dye, nitrohumic acid and a salt thereof, an amino compound of a metal complex of salicylic acid, naphthoic acid, and dicarboxylic acid with Co, Cr, and Fe etc., a quaternary ammonium compound, organic dye, etc. may be used. Consumed quantity of the polarity controlling material used for the toner is determined by the kind of binder resin, presence or absence of additives used according to need, and a method of producing the toner including dispersion method, and will vary accordingly. However, from 0.1 to 20 parts by weight of the polarity controlling agent to 100 parts by weight of a binder material is prefered. If the above mentioned polarity controlling agent proportion is less than 0.1 parts by weight, charge quantity of the toners is deficient so that such a polarity controlling agent proportion is not practical. Also, if the proportion of polarity controlling agent is larger than 20 parts by weight, the charge quantity of the toners is too large and the electrostatic attractive force between the toner and the carrier will increase, so that decrease of the fluidity of the developer and decrease of the image density will result.

As for a black coloring agent included in the toners, for example, carbon black, aniline black, furnace black, and lamp black may be used. As for a cyan coloring agent, for example, phthalocyanine blue, methylene blue, Victoria blue, methyl violet, aniline blue, and ultramarine blue may be used. As for a magenta coloring agent, for example, rhodamine 6G lake, dimethylquinacridone, watching red, rose bengal, rhodamine B, and alizarin lake may be used. As for a yellow coloring agent, for example, chrome yellow, benzidine yellow, hansa yellow, naphthol yellow, molybdenum orange, quinoline yellow, and tartrazine may be used.

Furthermore, a toner including a magnetic material can be used as a magnetic toner. As a magnetic material included in a magnetic toner, an iron oxide such as magnetite, hematite, and ferrite, a metal such as iron, cobalt, nickel or an alloy among these metals and metals such as aluminum, cobalt, copper, lead, magnesium, tin, zinc, antimony, beryllium, bismuth, cadmium, calcium, manganese, selenium, titanium, tungsten, vanadium, and a mixture thereof may be used. The ferromagnetic material will preferably have an averaged particle diameter of about from 0.1 to 2 $\mu$m, and the quantity included in the toners is about 20 to 200 parts by weight, and more preferably 40 to 150 parts by weight combined with 100 parts by weight of resin component.

Also, as an additive added to the toner, an inorganic powder of cerium oxide, silicon dioxide, titanium oxide, silicon carbide, etc can be used. Colloidal silica is particularly preferable as a toner additive.

A carrier capable of being used in the present invention, is for example, a powder having magnetic properties such as iron powder, ferrite powder, and nickel powder and a powder of which a surface thereof is treated by resin, etc. In order to develop a latent image faithfully by stabilizing frictional electrification of the toners used in the present invention, the toners are preferably coated by a resin and/or a silicone compound. Thereby, control of toner charging can be also performed.

As for a resin to form a coating layer of a carrier, for example, a silicone-based compound and a fluorocarbon resin can be preferably used. As for a fluorocarbon resin to form a coating layer of a carrier, for example, a perfluoropolymer such as polyvinyl fluoride, polyvinylidene fluoride, polytrifluoro ethylene, polychloro trifluoro ethylene, polytetrafluoro ethylene, polyperfluoro propylene, copolymer of vinylidene flioride and acrylic monomer, copoly(vinylidene fluoride/chlorotrifluoroethylene), copoly (tetrafluoroethylene/hexafluoropropylene), copoly(vinyl fluoride/vinylidene fluoride), copoly(vinylidene fluoride/tetrafluoroethylene), copoly(vinylidene fluoride/hexafluoropropylene), and fluoroterpolymer such as terpolymer of tetrafluoroethylene, vinylidene fluoride, and a non-fluoridated monomer are preferably used. In formation of a coating layer of a carrier, the fluorocarbon resin described above may be used independently or as a mixture thereof. A mixture of the resin and other polymers may be used.

As for a silicon-based compound to form a coating layer of a carrier, for example, a polysiloxane such as methylpolysiloxane and methylphenylpolysiloxane is used; and a modified resin such as alkyd modified silicon, epoxy modified silicon, polyester modified silicon, urethane modified silicon, and acryl modified silicon can be also used. As for a modified form of the resin, block copolymer, graft copolymer, and wedge garft-polysiloxane can be used.

With respect to application to surfaces of actual magnetic particles, a method in which the resin is sprayed on the magnetic particles by immersing or fluid bed can be carried out.

As for a material of a substrate of the carrier used in the present invention, for example, a metal such as surfaceoxidized or unoxidized iron, nickel, cobalt, manganese, chromium, and rare earth elements, and an alloy or oxides thereof can be used. However, preferably a metal oxide, and more preferably ferrite particles, will be used. The production method is not limited. As to the proportion of the carriers and the toners according to the present invention, both particles are preferably mixed such that toner particles adhere to the surface of the carrier particles and occupy about from 30 to 90% of the surface area of the carrier particles.

Next, an electro-photographic photo conductor used in the present invention will be illustrated with attached drawings.

Figure 2:
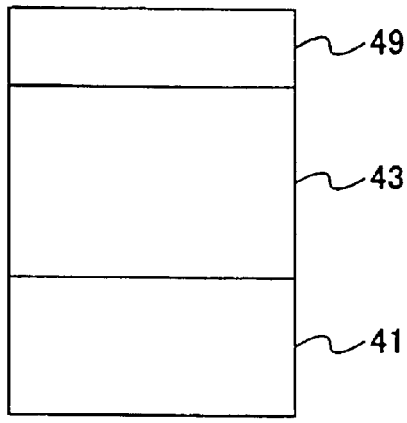
FIG. 2 shows a cross-section of an electro-photographic photo conductor having another structure according to the present invention.

FIG. 2 shows a cross-section of an electro-photographic photo conductor used in the present invention. The single photosensitive layer 43 including mainly a charge generating material and a charge transfer material is laid on the conductive supporter 41, and the protective layer 49 is laid on the photosensitive layer.

Figure 3:
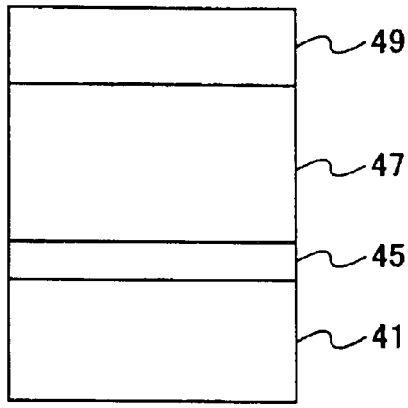
FIG. 3 shows a cross-section of an electro-photographic photo conductor having yet another structure according to the present invention.

FIG. 3 shows a cross-section of an electro-photographic photo conductor having another structure used in the present invention. In FIG. 3, the photosensitive layer has a structure such that the charge generating layer 45 including mainly a charge generating material and the charge transfer layer 47 including mainly a charge transfer material are laminated, and the protective layer 49 is laid on the charge transfer layer 47.

Figure 4:
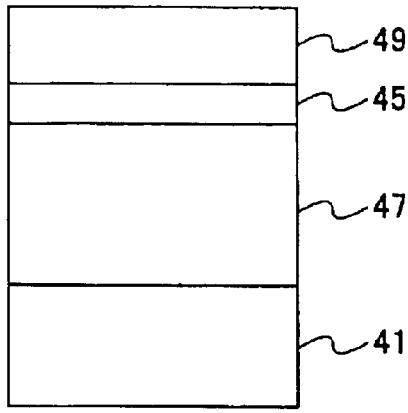
FIG. 4 shows a cross-section of an electro-photographic photo conductor having yet another structure according to the present invention.

FIG. 4 shows a cross-section of an electro-photographic photo conductor having another structure used in the present invention. In FIG. 4, the photosensitive layer has structure such that the charge transfer layer 47 including mainly a charge transfer material and the charge generating layer 45 including mainly a charge generating material are laminated, and the protective layer 49 is laid on the charge generating layer 45.

As for the conductive supporter 41, a product of a plastic in the form of film or a cylinder or a paper coated with a material having conductivity specified with volume resistivity equal to or less than $10^{10}$ Ω-cm, which is for example, a metal such as aluminum, nickel, chromium, nichrome, copper, gold, silver, and platinum or a metal oxide such as tin oxide and indium oxide, formed by vapor deposition or sputtering can be used. Also, a plate made from aluminum, aluminum alloy, nickel, or stainless etc. and a pipe which is roughly formed by extrusion and drawing process from the plate followed by surface treatment such as cutting, super finishing, and polishing. can be used. An endless nickel belt and an endless stainless belt can be used as the conductive supporter 41, which is disclosed on Japanese Laid-Open patent application No. 52-36016.

Also, a cylindrical supporter made from aluminum, to which anodizing can be easily applied, can be best used. The referred term "aluminum" includes both pure aluminum and an aluminum alloy. Specifically, aluminum selected from JIS No. 1000, 3000, and 6000 groups or an aluminum alloy is most appropriate. An oxide film on an anode is formed by anodizing each kind of metal or each kind of metal alloy in electrolyte solution. However, the coating called alumite in which aluminum or an aluminum alloy is anodized in electrolyte solution is most appropriate for a photo conductor used in the present invention. Especially, the above preferred conductive supporter excels in respect to preventing point defects (black points and stains on image background) from being generated when it is used in reverse development (negative or positive development).

Anodizing is carried out in acid solution of chromic acid, sulfuric acid, oxalic acid, phosphoric acid, boric acid and sulfamic acid, etc. Anodizing in a sulfuric acid bath is most appropriate. For example, anodizing is carried out under the conditions in which the concentration of sulfuric acid is 10–20%, bath temperature is 5–25° C., current density is 1–4 A/dm$^2$, bath voltage is 5–30V, and time period for anodizing is about 5–60 minutes, but anodizing is not limited to these conditions. The oxidation film on an anode formed like above is porous and has high insulating property so that a surface of the film is in unstable condition. Therefore, time variation of the anodized film may occur, and a physical value for the film is likely to be varied. In order to prevent the variation, it is preferable to further apply a sealing treatment to the anodized film. As sealing treatment, several methods can be used, that is, a method to immerse the anodized film in a solution including nickel fluoride or nickel acetate, a method to immerse the anodized film in boiling water, and a method to treat the film by pressure steam. Among the methods, the method of immersion in a solution including nickel acetate is most preferable. A washing treatment is applied to anodized film following the sealing treatment. A main object of the washing treatment is to remove excess metal salt, etc., adhering as a result of the sealing treatment. If the excessive salt remains on a surface of the supporter (the anodized film), since low resistance components in the salt generally remain, the components cause generation of stains on image background as well as adverse effects on the quality of coating film formed on the surface. Although the washing treatment may be accomplished with purified water, multi-step washing is commonly performed. In this case, it is preferable for cleaning liquid to be used at final washing to be as clean (deionized) as possible. Also, it is desirable to physically rub the conductive supporter during washing by using a contact member in a process within a multi-step washing process. It is preferable that film thickness of the anodized film formed like above be about from 5 to 15 μm. If the thickness is thinner than 5 μm, the effect of barrier property of the anodized film is not enough. If the thickness is thicker than 15 μm, the time constant of the film as an electrode become too large, and generation of residual potential and deterioration of response of a photo conductor may occur.

As for the conductive supporter (41) according to the present invention, a product formed by applying a suitable binding resin in which conductive powders are dispersed on the supporter, can be used. The conductive powder may be carbon black, acetylene black, metal powder made from a metal such as aluminum, nickel, iron, nichrome, copper, zinc, and silver, or metal oxide powder made from a metal oxide such as conductive tin oxide and ITO. As for the binding resin used at the same time, thermoplastic, thermosetting, and photo-curing resin such as polystyrene, copoly(styrene/acryronitrile), copoly(styrene/butadiene), copoly(styrene/maleic anhydride), polyester, polyvinyl chloride, copoly(vinyl chloride/vinyl acetate), polyvinyl acetate, polyvinylidene chkoride, polyarylate resin, phenoxy resin, polycarbonate, acetylcellulose resin, ethylcellulose resin, polyvinylbutyral resin, polyvinyl formal resin, polyvinyl toluene, poly-N-vinyl carbazole, acrylic resin, silicone resin, epoxy resin, melamine formaldehyde resin, urethane resin, phenol resin, and alkyd resin, are given. Such a conductive layer can be formed by applying a product in which the conductive powder and the binding resin are dispersed in an appropriate solvent, for example, tetrahydrofuran, dichloromethane, ethyl methyl ketone, and toluene, on the supporter.

Further, a product formed by laying a conductive layer which is a heat contraction tube produced by adding the conductive powder to a material such as polyvinyl chloride, polypropylene, polyester, polystyrene, polyvinylidene chloride, ployethylene, chlorinated rubber, and Teflon, on an appropriate cylindrical substrate, can be used as for the conductive supporter 41 according to the present invention.

Next the photosensitive layer will be illustrated. The photosensitive layer may be a single layer or a laminated layer. A photosensitive layer consisting of the charge generation layer 45 and the charge transfer layer 47 is illustrated at first. The charge generation layer 45 is a layer including a charge generation material as a main component and may be made from a binder resin according to need. An inorganic material and an organic material can be used as a charge generation material.

The inorganic material may be crystal selenium, amorphous selenium, selenium-tellurium system, selenium-tellurium-halogen system, selenium-arsenic system, and amorphous silicon, etc. With respect to amorphous silicon, amorphous silicon in which dangling bond is terminated by hydrogen atom and/or halogen atoms or in which boron atom and/or phosphorus atom are doped, is used well. As for the organic material, a well-known material can be used. For example, phthalocyanine-based pigment such as phthalocyanine containing a metal ion, phthalocyanine not containing a metal ion, azulenium salt pigment, methyl squarate pigment, azo pigment having carbazole skelton, azo pigment having triphenylamine skelton, azo pigment having diphenylamine skelton, azo pigment having dibenzothiophene skeleton, azo pigment having fluorenone skelton, azo pigment having oxadiazole skelton, azo pigment having bis-stilbene skelton, azo pigment having distyryloxadiazole skelton, azo pigment having distyrylcarbazole skelton, perylene-based pigment, anthraquinone-based or polycyclic quinone-based pigment, quinoneimine-based pigment, diphenylmethane and triphenylmethane-based pigment, benzoquinone and naphthoquinone-based pigment, cyanine and azomethyne-based pigment, indigoid-based pigment, bis-benzimidazole-based pigment are given. The charge generating materials may be utilized independently or as a mixture of more than one kind thereof.

Azo pigments and/or phthalocyanine pigments are effectively utilized. Especially, azo pigments represented by the following structural formula (A):

(A)

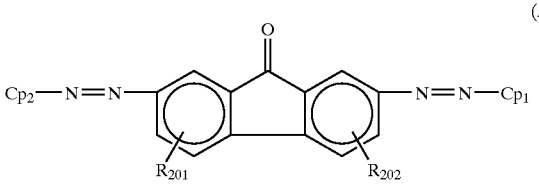

and titanylphthalocyanine (escpecially, having at least a maximum diffraction peak at 27.2° as diffraction peak at Bragg angle 2θ (±0.2°) for characteristic X-ray of CuKα) can be effectively utilized.

$Cp_1$ and $CP_2$ in the formula (A) are coupler residues, which are identical or different from each other. $R_{201}$, and $R_{202}$ are respecively selected from a group consisting of hydrogen atom, halogen atoms, alkyl groups, alkoxy groups, and cyano group, which are identical or different from each other. Also, $Cp_1$ and $CP_2$ are represented by the following structural formula (B).

(B)

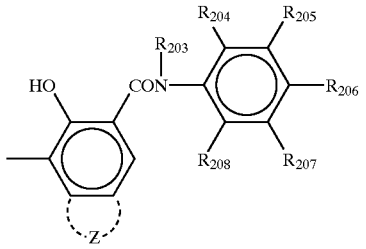

$R_{203}$ in the formula (B) is selected from a group consisting of hydrogen atom, alkyl groups such as methyl group and ethyl group, and aryl groups such as phenyl group. $R_{204}$, $R_{205}$, $R_{206}$, $R_{207}$, and $R_{208}$ are independently selected from a group consisting of hydrogen atom, nitro group, cyano group, halogen atoms such as fluorine, chlorine, bromine, and iodine, trifluoromethyl group, alkyl groups such as methyl group and ethyl group, alkoxy groups such as methoxy group and ethoxy group, dialkylamino group, and hydroxyl group, and Z represents an atom group required for forming a substituted or non-substituted aromatic carbon ring or a substituted or non-substituted aromatic heterocyclic ring.

Especially, an asymmetric azo pigment in which said $Cp_1$ and $Cp_2$ have different structures from each other has better photosensitivity than a symmetric azo pigment in which said $Cp_1$ and $Cp_2$ have structures identical to each other. The asymmetric azo pigment can respond to downsizing a diameter of a photo conductor and to speed up used process, to be effectively utilized.

Also, in titanylphthalocyanine having a maximum diffraction peak at 27.2° as diffraction peak at Bragg angle 2θ (±0.2°), particularly, titanylphthalocyanine having a peak at 7.3° as a minimum angle can be effectively utilized.

The charge generating materials may be utilized independently or as a mixture of more than ne kind thereof.

As for a binding resin used in the charge enerating layer, according to need, polyamide, polyurethane, epoxy resin, polyketone, polycarbonate, silicon resin, acrylic resin, polyvinyl butyral, polyvinyl formal, polyvinyl ketone, polystyrene, polysulfone, poly-N-vinyl carbazole, polyacrylamide, polyvinyl benzal, polyester, phenoxy resin, copoly(vinyl chloride/vinyl acetate), polyphenylene oxide, polyamide, polyvinyl pyridine, cellulose based resin, casein, polyvinyl alcohol, and polyvinyl pyrrolidone etc. are given. Appropriate quantity of the binding resin is from 0 to 500 parts by weight, and preferably from 10 to 300 parts by weight, to 100 parts by weight of the charge generating material.

As for a method for forming the charge generating layer 45, vacuum thin film process and casting process from solution and dispersion systems are mainly given. With respect to the former method, vacuum vapor deposition, glow discharge decomposition, ion plating, sputtering, reactive sputtering, and CVD method, etc., are used to form the charge generating layer 45 made from an inorganic material or an organic material described above. In order to form the charge generating layer by the latter casting method, the layer can be formed by applying an appropriately diluted dispersion liquid in which the inorganic or organic charge generating material described above is dispersed, with a binder resin if necessary, in a solvent such as tetrahydrofuran, cyclohexane, dioxane, dichloroethane, and butanone by means of ball mill, atriter, sand mill etc. As for the application, a method such as immersion coating, spray coating, bead coating, nozzle coating, spinner coating, and ring coating can be used. The film thickness of the charge generating layer 45 is appropriately about from 0.01 to 5 μm and more preferably from 0.1 to 2 μm.

The charge transfer layer 47 is formed by applying and drying the solution or dispersion liquid in which a charge transfer material and a binder resin are dissolved or dispersed into an appropriate solvent. If necessary, a plasticizer, a leveling agent, and an antioxidant may be added to the solution and the dispersion liquid.

The charge transfer materials are classified as hole transfer materials and electron transfer materials. As for the charge transfer material, for example, an electron-accepting material such as chloranyl, bromanyl, tetracyanoethylene, tetracyanoquinodimethane, 2,4,7-trinitro-9-fluorenone, 2,4,5,7-tetranitro-9-fluorenone, 2,4,5-tetranitroxanthone, 2,4,8-trinitrothioxanthone, 2,6,8-trinitro-4H-indeno [1,2-b] thiophene-4-one, 1,3,7-trinitrodibenzothiophene-5,5-dioxide; and benzoquinone derivatives are given.

As for a hole transfer material, poly-N-vinyl carbazole and derivatives thereof, poly-γ-carbazolyl ethyl glutamate and derivatives thereof, a condensate of pyrene and formaldehyde and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, enamine derivatives, and other well-known materials are given. The charge transfer materials are utilized independently or as a mixture of more than one kind thereof.

As for a binding resin, thermoplastic or thermosetting resin such as polystyrene, copoly(styrene/acryronitrile), copoly(styrene/butadiene), copoly(styrene/maleic anhydride), polyester, polyvinyl chloride, copoly(vinyl chloride/vinyl acetate), polyvinyl acetate, polyvinylidene chkoride, polyarylate resin, phenoxy resin, polycarbonate, acetylcellulose resin, ethylcellulose resin, polyvinyl butyral resin, polyvinyl formal resin, polyvinyl toluene, poly-N-vinyl carbazole, acrylic resin, silicone resin, epoxy resin, melamine formaldehyde resin, urethane resin, phenol resin, and alkyd resin etc. are given.

Appropriate quantity of the charge transfer material is from 20 to 300 parts by weight, and preferably from 40 to 150 parts by weight, to 100 parts by weight of a binder resin. It is preferable that the film thickness of the charge transfer layer be about from 5 to 100 μm. As for solvent used here, tetrahydrofuran, dioxane, toluene, dichloromethane, monochlorobenzene, dichloroethane, cyclohexane, ethyl methyl ketone and acetone etc. are given.

Also, a polymer having electron-donating groups can be included in the charge transfer layer. A polymer having electron-donating groups includes a polymeric charge transfer material having a function as a charge transfer material and a function as a binder resin, or a polymer of which monomers or oligomers have electron-donating groups at time of film formation of the charge transfer layer and a two or three dimensional crosslinking structure is formed at last by setting reaction or crosslinking reaction after film formation. A charge transfer layer consisting of the polymeric charge transfer material or a polymer having closslinking structure excels in respect to wear resistance. Generally, in a electro-photographic process, since electric potential at the charged areas (electric potential at the unexposed areas) is constant, if a surface layer of a photo conductor is worn by repeated use, electric field strength applied to a photo conductor becomes stronger depending on the wear. Since generation frequency of stains on the background become higher with elevation of the electric field strength, high wear resistance of a photo conductor is advantageous for preventing the stains on the background.

A charge transfer layer consisting of the polymeric charge transfer materials excels in film formation property and in charge transfer efficieny since the charge transfer layer is formed to be at a high density compared to the charge transfer layer consisting of low molecular weight dispersion type polymer. Thereby, a photo conductor having a charge transfer layer formed by the polymeric charge transfer material is expected to have high speed response. As for the polymeric charge transfer material, although well-known materials can be used, a polycarbonate containing triarylamine structure in its main chain and/or its side chain is well utilized. Especially, a polymeric charge transfer material represented by the general formula (I) to (X), which will be shown below, is well used, and the embodiments of the material will also be shown below.

(I)

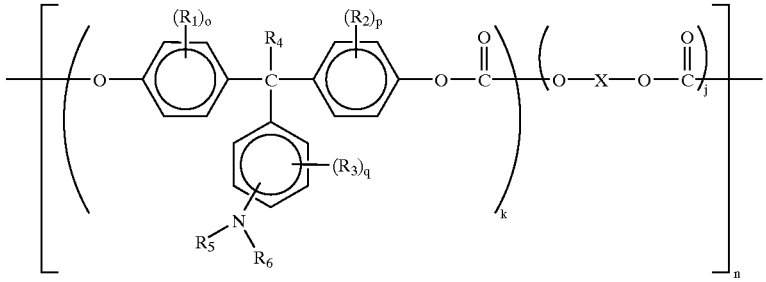

In the formula (I), $R_1$, $R_2$, and $R_3$ are independently selected from a group consisting of substituted or not substituted alkyl groups containing 1 to 4 carbon atoms or halogen groups. $R_4$ is hydrogen atom or substituted or not substituted alkyl groups containing 1 to 4 carbon atoms. $R_5$ and $R_6$ are substituted or not substituted aryl groups. o, p, and q are independently selected from integers from 0 to 4. k and j mean composition of the compound and satisfy relations $0.1 \leqq k \leqq 1$ and $0 \leqq j \leqq 0.9$. n means repeating units and is an integer from 0 to 5000. X is an aliphatic divalent group, alicyclic divalent group, or a divalent group represented by the following general formula.

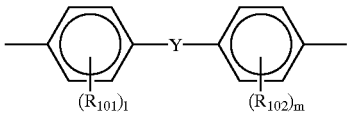

In the above formula, $R_{101}$ and $R_{102}$ are independently selected from a group consisting of substituted or not substituted alkyl groups containing 1 to 4 carbon atoms, substituted or not substituted aryl groups and halogen atom, respectively. l and m are integers from 0 to 4. Y is selected a group consisting of from a single bond, alkylene groups being straight or branched chain or ring having 1 to 12 carbon atoms, —O—, —S—, —SO—, —CO—, —CO—O—Z—O—CO— in which Z is aliphatic divalent group, or

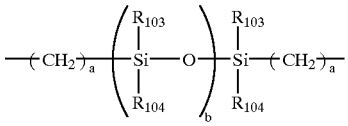

In the above formula, a is 1 or 2. b is an integer from 1 to 2000. $R_{103}$, and $R_{104}$ are substituted or not substituted alkyl groups containing 1 to 4 carbon atoms or substituted or not substituted aryl groups. Herein, $R_{101}$ and $R_{102}$, and $R_{103}$ and $R_{104}$ are identical or different from each other.

(II)

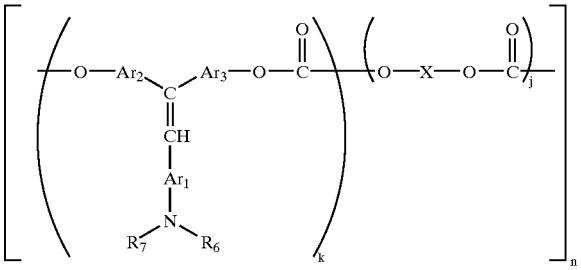

In the above formula, $R_7$ and $R_8$ are substituted or not substituted aryl groups, and $Ar_1$, $Ar_2$, and $Ar_3$ are identical or different arylene groups. X, k, j, and n are same as the case of formula (I).

(III)

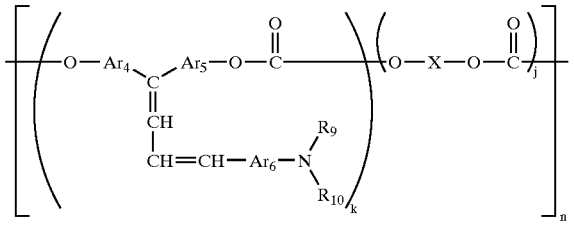

In the above formula, $R_9$ and $R_{10}$ are substituted or not substituted aryl groups, and $Ar_4$, $Ar_5$, and $Ar_6$ are identical or different arylene groups. X, k, j, and n are same as the case of formula (I).

(IV)

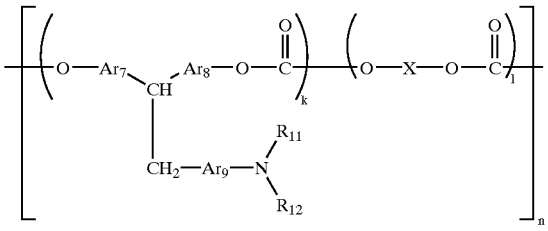

In the above formula, $R_{11}$ and $R_{12}$ are substituted or not substituted aryl groups, and $Ar_7$, $Ar_8$, and $Ar_9$ are identical or different arylene groups. P is an integer from 1 to 5. X, k, j, and n are same as the case of formula (I).

(V)

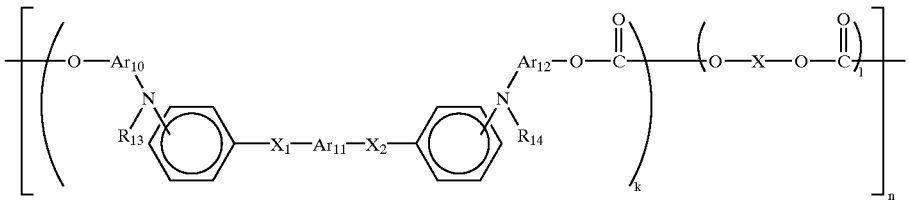

In the above formula, $R_{13}$ and $R_{14}$ are substituted or not substituted aryl groups, and $Ar_{10}$, $Ar_{11}$, and $Ar_{12}$ are identical or different arylene groups. $X_1$ and $X_2$ are substituted or not substituted ethylene groups or substituted or not substituted vinylene groups. X, k, j, and n are same as the case of formula (I).

(VI)

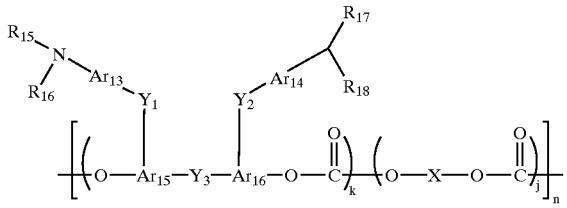

In the above formula, $R_{15}$, $R_{16}$, $R_{17}$, and $R_{18}$ are substituted or not substituted aryl groups, and $Ar_{13}$, $Ar_{14}$, $Ar_{15}$ and $Ar_{16}$ are identical or different arylene groups. $Y_1$, $Y_2$ and $Y_3$ are selected from a group consisting of a single bond, substituted or not substituted alkylene groups, substituted or not substituted cycloalkylene groups, substituted or not substituted oxyalkylene groups, oxygen atom, sulfur atom, and vinylene group, and may be identical or different from each other. X, k, j, and n are same as the case of formula (I).

(VII)

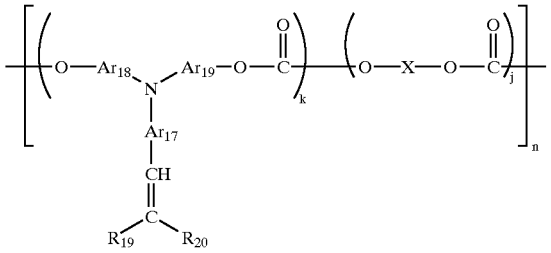

In the above formula, $R_{19}$ and $R_{20}$ are selected from a group consisting of hydrogen atom and substituted or not substituted aryl groups, and $R_{19}$ and $R_{20}$ have ring structures respectively. $Ar_{17}$, $Ar_{18}$ and $Ar_{19}$ are identical or different arylene groups. X, k, j, and n are same as the case of formula (I).

(IX)

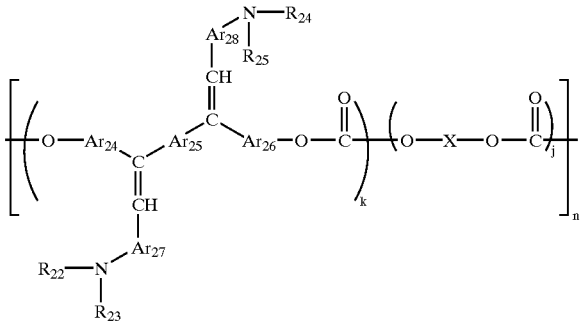

In the above formula, $R_{22}$, $R_{23}$, $R_{24}$ and $R_{25}$, are selected from substituted or not substituted aryl groups, and $Ar_{24}$, $Ar_{25}$, $Ar_{26}$, $Ar_{27}$, and $Ar_{28}$, are identical or different arylene groups. X, k, J, and n are same as the case of formula (I).

(X)

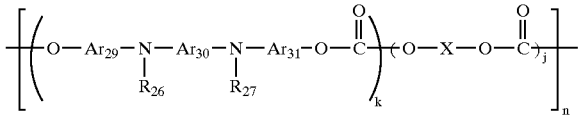

In the above formula, $R_{26}$ and $R_{27}$ are selected from substituted or not substituted aryl groups, and $Ar_{29}$, $Ar_{30}$, and $Ar_{31}$ are identical or different arylene groups. X, k, j, and n are same as the case of formula (I).

The polymeric charge transfer materials may be used independently or as a mixture with more than one kind of the other polymeric charge transfer materials. Also, a low molecule weight charge transfer material can be combined with the above mentioned materials. As for other polymers having electron-donating groups, copolymers of well-known monomers, block copolymers, graft copolymers, star polymers, and crosslinking polymers having electron-donataing groups, for example disclosed in Japanese Laid-Open Patent Application No. 3-34001, 2000-206723, and 2001-34001 are included in the materials and can be well utilized.

In a photo conductor according to the invention, a plasticizer and a leveling agent may be added to the charge (VII)

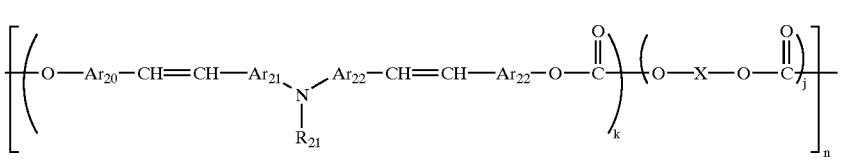

In the above formula, $R_{21}$ is selected from substituted or not substituted aryl groups, and $Ar_{20}$, $Ar_{21}$, $Ar_{22}$ and $Ar_{23}$, are identical or different arylene groups. X, k, j, and n are same as the case of formula (I).

transfer layer 47. As for a plasticizer, dibutylphthalate and dioctylphthalate etc., which are used as a general plasticizer, can be used, and the consumed quantity of the plasticizer is about from 0 to 30% by weight to a binding resin. As for a leveling agent, silicone oils such as dimethylsilicone oil and phenylmethylsilicone oil and a polymer or oligomer having perfluoroalkyl groups to side chains thereof are used, and the consumed quantity of the polymer or oligomer is about from 0 to 1% by weight to a binding resin.

Next, the case of a photo conductor having a single layer structure will be illustrated. A photosensitive layer in which at least the above mentioned charge generating material is dispersed in a binding resin can be used. A single photosensitive layer can be formed by applying and drying a liquid in which a charge generating material and a binding resin are dissolved or dispersed in an appropriate solvent. Further, the photosensitive layer may be a function separating type, to which the above mentioned charge transfer material is added, and can be used well. Also, if necessary, a plasticizer, a leveling agent, and an antioxidant can be added.

As for a binding resin, other than the binding resin used in the charge transfer layer 47 given above which may be also used itself, the binding resin used in the charge generating layer 45 given above may be mixed with the former binding resin. Of course, the polymeric charge transfer materials given above can be used well. To 100 parts by weight of a binding resin, the amount of the charge generating material is preferably from 5 to 40 parts by weight, and the amount of the charge transfer material is preferably from 0 to 190 parts by weight and more preferably from 50 to 150 parts by weight. A single photosensitive layer can be formed by applying liquid for coating in which a charge generating material and a binding resin, if necessary with the charge transfer material, are dispersed by a dispersing machine into a solvent such as tetrahydrofuran, dioxane, dichloroethane, and cyclohexane, using methods such as immersion coating, spray coating, bead coating, nozzle coating, spinner coating, and ring coating. It is appropriate for the thickness of the single photosensitive layer to be about from 5 to 100 $\mu$m.

In a photo conductor according to the present invention, an under coating layer, not shown in figures, can be inserted between the conductive supporter 41 and the photosensitive layer. Although an under coating layer generally includes resin as a main component, it is desirable for the resin to have high dissolution resistance to general organic solvents since a photosensitive layer is applied on the resin with a solvent. As for such a resin, a water soluble resin such as poly(vinyl alcohol), casein, and poly(sodium acrylate), an alcohol soluble resin such as copolyammide, and methoxymethyl nylon, a curing type resin forming three dimensional network structures such as polyurethane, melamine formaldehyde resin, phenol resin, alkyd-melamine resin, and epoxy resin are given. Also, fine powder pigment of metal oxides such as titanium oxide, silica, alumina, zirconium oxide, tin oxide, indium oxide shown as examples may be added to an under coating layer to prevent generation of moire and to decrease residual potential.

The under coating layer can be formed by using appropriate solvents and coating methods as similar to the case of the above mentioned photosensitive layer. Further, as for the under coating layer according to the present invention, a silane coupling agent, a titanium coupling agent, and a chromium coupling agent etc. may be used. $Al_2O_3$ produced by anodizing, an organic material such as poly (paraxylylene) (parylene) etc. and an inorganic material such as $SiO_2$, $SnO_2$, $TiO_2$, ITO, and $CeO_2$, formed by vacuum thin film production method, can be used well for an under coating layer according to the present invention. Well-known materials other than above mentioned materials can be used. The film thickness of the under coating layer is appropriately from 0 to 5 $\mu$m.

In the photo conductor according to the present invention, the protecting layer 49 as an outermost layer is formed on the photosensitive layer for protecting the photosensitive layer. As for a material employed in the protecting layer, resins such as AB resin, ACS resin, copoly(olefin/vinyl monomer), chlorinated polyether, allyl resin, phenol resin, polyacetal, polyamide, polyamideimide, polyacrylate, polyallylsulfone, polybutylene, polybutylene terephthalate, polycarbonate, polyether sulfone, polyethylene, polyethylene terephthalate, polyimide, acrylic resin, polymethyl benten, polypropylene, polyphenylene oxide, polysulfone, polysulfone, polystyrene, AS resin, copoly(butadienei/styrene), polyurethane, polyvinyl chloride, polyvinylidene chloride, and epoxy resin are given.

As for a protecting layer, fluorocarbon resins such as polytetrafluoro ethylene, silicone resin, a material in which dispersion of an inorganic filler such as titanium oxide, tin oxide, potassium titanate, and silica or an organic filler is added to the resins can be added for improving wear resistance. A metal oxide is used well, and alumina, titanium oxide, and silica are particularly used well.

Also, it is preferable to add a charge transfer material to the protecting layer 49 for decreasing residual potential and improving sensitivity to light and response speed. As an added charge transfer material, a low molecular weight charge transfer material described with respect to the above mentioned polymeric charge transfer materials 45 is used. Furthermore, the above mentioned polymeric charge transfer material is also used well in respect to improving wear resistance and response speed. As for a method for forming a protecting layer, a normal application method is employed. It is appropriate for the thickness of a protecting layer to be about from 0.1 to 10 $\mu$m.

Furthermore, suppression for elevation of residual potential is realized by adding an organic compound having acid value from 10 to 400 (mgKOH/g). The referred term "acid value" is defined as the number of milligrams of potassium hydroxide required for neutralizing free fatty acids included in 1 g of a remarked material. As an organic compound in which acid value is from 10 to 400 (mgKOH/g), all of the generally known organic fatty acids and high acid value resins etc. can be used if the materials have acid values from 10 to 400 (mgKOH/g). However, since an organic acid and an acceptor having very low molecular weight have the capability to decrease the dispersion property of a filler, the effect of decreasing residual potential may not be exerted by using the compounds. Therefore, it is preferable to use a low molecular weight polymer and resin, copolymer, etc., and a mixture thereof in order to decrease residual potential of a photo conductor and to improve dispersion property of a filler. It is preferable for the organic compounds to have linear molecular structures and less steric hindrance. It is necessary to make both a filler and a binder resin having affinity in order to improve the dispersion property. A material having high steric hindrance decreases the affinity to degrade the dispersion property and causes many problems described above.

As for an organic compound having acid value from 10 to 400 (mgKOH/g), it is particularly preferable to use polycarboxylic acid. The polycarboxylic acid is a compound having the structure that carboxylic acids are included in a polymer or a copolymer. All of the organic compounds containing carboxylic acid and their derivatives such as polyester resin, acrylic resin, copolymers produced by using acrylic acid and methacrylic acid, and styreneacrylcopolymer can be used. It is possible to use a mixture of more than one of the compounds, and the mixture is useful. Depending on the situation, by mixing the compound and an organic fatty acid, the dispersion property of the filler and the associated effect of decreasing residual potential may be improved. The amount of the added organic compounds having acid value from 10 to 400 (mgKOH/g) is from 0.01 wt % to 50 wt %, preferably from 0 wt % to 20 wt % to the amount of the contained filler. However it is more preferable to add the required minimum quantity. If the addition quantity is more than a minimum requirement, image blur may result. If the addition quantity is too small, the effect of decreasing residual potential is not enough sufficiently realized. Acid value of the organic compound is preferably from 10 to 400 mgKOH/g, and more preferable from 30 to 200 mgKOH/g. If the acid value is higher than a requirement, the resistance is reduced too much and the image blur becomes large. If the acid value is too small, the addition quantity has to be increased and the effect of decreasing residual potential is not sufficiently realized. Herein, it is necessary for the acid value of the organic compound to be determined depending on the addition quantity. However, the acid value of the organic compound does not directly cause the effect of decreasing residual potential, which more significantly depends on structure or molecular weight of the organic compound used and the dispersion property of a filler etc.

In the photo conductor according to the present invention, an intermediate layer, not shown in the figures, can be laid between a photosensitive layer and a protecting layer. For the intermediate layer, a binder resin is generally used as the main component. As for the resin, polyamide, alcohol soluble nylon, water soluble polyvinyl butyral, polyvinyl alcohol, etc., are given. As a formation method of the intermediate layer, normal application methods are employed as described before. It is preferable for the thickness of the intermediate layer to be from 0.05 to 2 $\mu$m.

In the present invention, an antioxidant, a plasticizer, a lubricant, an ultraviolet absorbent, a low molecular weight charge transfer material, and a leveling agent can be added to each layer for improving adaptation to the environment and particularly for preventing decrease of sensitivity and elevation of residual potential. The representative materials of the compounds are described below.

As an antioxidant capable of being added to each layer, for example, the following materials are given, but an antioxidant is not limited to these.

(a) Phenols 2,6-di-t-butyl-p-cresol, butyklhydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[metylene-3-(3',5'-di-t-butyl-4'-hydroxyphenyl)propionate]methane, bis[3,3'-bis(4'-hydroxy-3'-t-butylphenyl)butyric acid]glycol ester, tocopherol, etc.

(b) Paraphenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N-dimethyl-N,N-di-t-butyl-p-phenylenediamine, etc.

(c) Hydroquinones 2,5-di-t-octylhydroquinone, 2,6-didodecyl hydroquinone, 2-dodecylhydroquinone, 2-dodecyl-5-chlorohydroquinone, 2-t-octyl-5-methylhydroquinone, and 2-(2-octadecenyl)-5-methylhydroquinone, etc.

(d) Organic sulfur compounds dilauryl-3,3'-thiodipropionate, distearyl-3,3'-thiodipropionate, and ditetradecyl-3,3'-thiodipropionate, etc.

(e) Organic phosphorus compounds triphenylphosphine, tri(nonyl phenyl)phosphine, tri (dinonyl phenyl)phosphine, trikrezylphophine, and tri(2, 4-dibutyl pkenoxy)phosphine, etc.

As for a plasticizer capable of being added to each layer, for example, the following materials are given, but a plasticizer is not limited to these.

(a) Phosphate-based plasticizers triphenyl phosphate, trikrezyl phosphate, trioctyl phosphate, octyl diphenyl phosphate, trichloroethyl phosphate, krezyl diphenyl phosphate, tributyl phosphate, tri-2-ethylhexyl phosphate, and triphenyl phosphate, etc.

(b) Phthalate-based plasticizers dimethyl phthalate, diethyl phthalate, diisobutyl phthalate, dibutyl phthalate, diheptyl phthalate, di-2-ethyl hexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleyl phthalate, decyl octyl phthalate, dibutyl fumarate, and dioctyl fumarate, etc.

(c) Aromatic carboxylate-based plasticizers trioctyl trimellitate, tri-n-octyl trimellitate, and octyl oxybenzoate, etc.

(d) Ester of aliphatic dibasic acid-based plasticizers dibutyl adipate, di-n-hexyl adipate, di-2-ethylhexyl adipate, di-n-octyl adipate, n-octyl-n-decyl adipate, diisiodecyl adipate; dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl sebacate, dioctyl tetrahydrophthalate, and n-octyl tetrahydrophthalate, etc.

(e) Fatty acid ester derivatives butyl oleate, grycerine monooleic acid ester, pentaerisritol ester, dipentaerisritol hexaester, triacetin, and tribuyne, etc.

(f) Oxycarboxylate-based plasticizers methyl acetylricinoleate, butyl acetylricinoleate, butylphthalylbutyl glycolate, and tributyl acetylcitrate, etc.

(g) Epoxy plasticizers epoxidated soya bean oil, epoxidated linseed oil, butyl epoxystearate, decyl epoxystearate, octyl epoxystearate, benzyl epoxy stearate, dioctyl epoxyhexahydrophthalate, and didecyl epoxyhexahydrophthalate, etc.

(h) Divalent alcohol ester-based plasticizers diethylene glycol dibenzoate, and triethylene glycol di-2-ethyl butyrate, etc.

(i)-Plasticizers including chlorine chlorinated paraffin, chlorinated diphenyl, chlorinated fatty acid methyl ester, and methoxy chlorinated fatty acid methyl ester, etc.

(j) Polyester-based plasticizers polypropyrene adipate, polypropyrene sebacate, polyester, and acetylized polyester, etc.

(k) Sulfonic acid derivatives p-toluene sulfonamide, o-toluene sulfonamide, p-toluene sulfonethylamide, o-toluene sulfonethylamide, toluene sulfone-N-ethylamide, p-toluene sulfone-N-and cyclohexylamide, etc.

(l) Citric acid derivatives triethyl citrate, triethyl acetylcitrate, tributyl citrate, tributyl acetylcitrate, tri-2-ethylhexyl acetylcitrate, and n-octyldecyl acetylcitrate, etc.

(m) Others terphenyl, partially hydrated terphenyl, camphor, 2-nitrodiphenyl, dinonylnaphthalene, and methyl abietate, etc.

As for a lubricant capable of being added to each layer, for example, the following materials are given, but a luburicant is not limited to these.

(a) hydrocarbons
liquid paraffin, paraffin wax, microwax, and low grade polymerized polyethylene, etc.

(b) Fatty acids
lauric acid, n-tetradecanoic acid, palmitin acid, stearic acid, arachic acid, and behenic acid, etc.

(c) Fatty acid amides
stearylamide, palmitylamide, oleinamide, methylenebisstearoamide, and ethylenebisstearoamide, etc.

(d) Esters
fatty acid lower alcohol ester, ester of fatty acid polyalcohol ester, and fatty acid polyglycol ester, etc.

(e) Alcohols
cetyl alcohol, stearyl alcohol, ethylene glycol, polyethylene glycol, and polyglycerol, etc.

(f) Metal soap
lead stearate, cadmium stearate, barium stearate, calcium stearate, zinc stearate, and magnesium stearate, etc.

(g) Natural wax
carnauba wax, candelilla wax, bees wax, whale wax, ibota wax and montan wax, etc.

(h) Others
silicone compounds and fluorine compounds, etc.

As for an ultraviolet absorbent capable of being added to each layer, for example, the following materials are given, but an ultraviolet absorbant is not limited to these.

(a) Benzophenone derivatives
2-hydroxybenzophenone, 2,4-dihydroxybenzophenone, 2,2, ',4'-trihydroxybenzophenone, 2,2',4,4'-tetrahydroxybenzophenone, and 2,2'-dihydroxy-4-methoxybenzophenone, etc.

(b) Salicylates
phenyl salicylate, and 2,4-di-t-butyl-3,5-di-t-butyl-4-hydroxybenzoate, etc.

(c) Benzotriazole derivatives
(2'-hydroxyphenyl)benzotriazole, (2'-hydroxy-51'-methylphenyl)benzotriazole, and (2'-hydroxy-3'-tert-butyl-5'-methylphenyl)-5-chlorobenzotriazole, etc.

(d) Cyanoacrylates
ethyl-2-cyano-3,3'-diphenylaccrylate and methyl-2-carbomethoxy-3-(paramethoxy)acrylate, etc.

(e) Quenchers (metallic complex salts)
nickel (2,2'-thiobis(4-t-octyl)phenolate)-n-butylamine, nickel dibutyldithiocarbamate, and cobalt dicyclohexyldithiophosphate, etc.

(f) HALS (hindered amines)
bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl) propionyloxy]-2,2,6,6-tetramethylpyridine, 8-benzyl-7,7,9,9-tetramethyl-3-octyl-1,3,8-triazaspiro [4,5]undecane-2,4-dione, and 4-benzoyloxy-2,2,6,6-tetramethylpyridine, etc.

Figure 5:
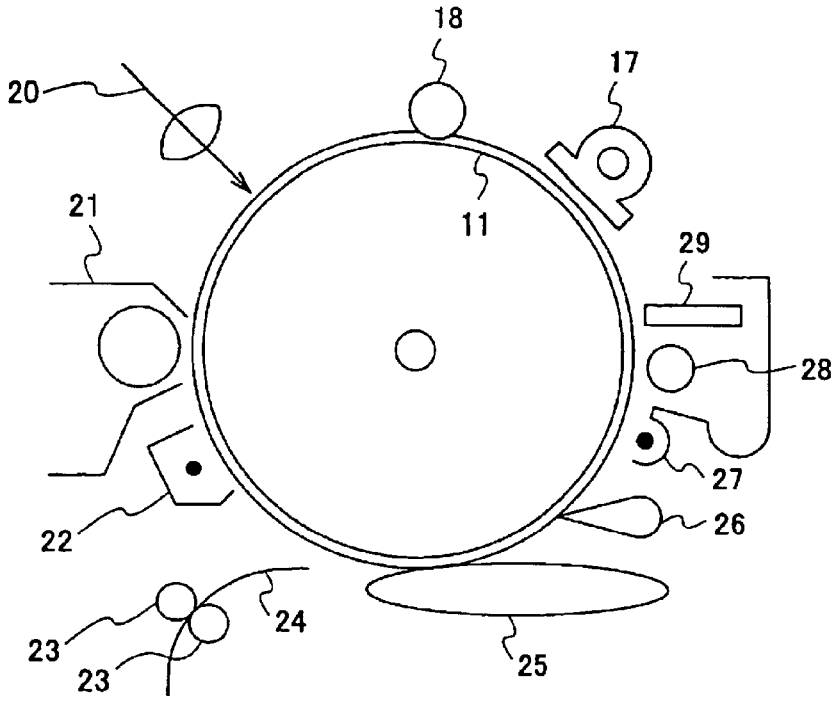
FIG. 5 shows a schematic to illustrate an electro-photographic process and an electro-photographic apparatus according to the present invention.

FIG. 5 is a schematic for illustrating an electrophotographic apparatus according to the present invention involving the variations described below. In FIG. 5, the photo conductor 11 is formed by laying a photosensitive layer and an outermost layer including a filler. The photo conductor 11 is shown in the form of a drum, but it may be in the form of a sheet or an endless belt.

The charger 18 contacts or is closely arranged to the photo conductor 11. The charger is used well, because the charger generates less ozone and nitrogen oxide, which become a source generating low resistance materials, than the case of a coronal charger represented by corotron and scorotron. Particularly, the charger arranged in close proximity to a non-contact charged roller, in which a distance between the charger and a surface of the photo conductor is equal to or less than 200 $\mu$m (preferably, equal to or less than 100 $\mu$m), is used well, since very little pollution is produced by the charger even with repeated use. According to need, the pre-transcription charger 22, a transcription charger, a separation charger, and the pre-cleaning charger 27 are arranged, and well-known means such as a corotron, a scorotron, a solid state charger, and a charged roller are used. When the photo conductor is charged by the charger, unevenness of charging can be effectively reduced by charging the photo conductor with an electric field formed by superposing an alternating current component on a direct current component in the charger. As for a transcription means, although the above charger can be generally used, the charger using transcription belt 25 shown in FIG. 5 can be preferably used.

As for a light source such as an image exposing unit 20 and charge removing lamp 17, all light emitters such as a fluorescent lamp, a tungsten lamp, a halogen lamp, a mercury lamp, a sodium lamp, light emitting diodes (LED), semiconductor lasers, and electro luminescence can be used. For providing light only at the desired spectral region, filters such as a sharply cutting filter, a bandpass filter, a near-infrared cutting filter, dichroicfilter, an interference filter, and a conversion filter for color temperature may be used.

Such a light source illuminates the photo conductor and thereby can be used to add a process such as a transcription process, a charge removing process, a cleaning process, or pre-exposure combined with light illumination, etc. other than the process shown in FIG. 5.

Toners developed by the development unit 21 on the photo conductor 11 are transferred to the transcription paper 24. However, not all of the toner is transferred, and some of the toner remains on the photo conductor 11. Such toner is removed from the photo conductor by a fur brush 28 and a cleaning brush 29. Cleaning may be performed by only a cleaning brush or by a combination such as a fur brush and a magfur brush used as a cleaning brush. A positive (negative) electrostatic latent image is formed on a surface of the photo conductor by providing a positive (negative) charge to the electro-photographic photo conductor followed by exposing the image. A positive image is obtained if a latent image is developed by negative (positive) polar toners (charge detecting particles), and a negative image is obtained if a latent image is developed by positive (negative) polar toners. A well-known means is applied to such a development means and also to such a charge removing means.

Furthermore, not shown in the figure, a member providing zinc stearate on the surface of the photo conductor may be placed. By the member providing zinc stearate on the surface of the photo conductor, it is possible to control filming which provides good wear resistance. Zinc stearate is effective for suppression of image distortion as well as for providing good wear resistance during repeated toner adhesion to the photo conductor and toner recovery by a cleaning means when the image is not formed, in the electrophotographic process using the photo conductor. As the means of providing said zinc stearate, it is very effective for zinc stearate to be included in the developer (toners) presented on the development means.

If the amount of zinc stearate provided on the photo conductor is too much, the amount of output also increases, and a fixation defect results which is not preferable. If a friction coefficient of a surface of the photo conductor is reduced to about 0.1 by providing too much zinc stearate, decrease of image density results which is not preferable. On the other hand, if the amount of zinc stearate is small, filming of toner component on the photo conductor is generated to cause image distortion or unevenness of contrast in the middle density which is not preferable. For example, when zinc stearate is included in toners to be provided on the surface of the photo conductor, it is preferable for the amount of included zinc stearate in the toners to be from 0.1 to 0.2% by weight.

In an image formation process according to the present invention, when an image is not formed, suppression of filming on a surface of the photo conductor in order to keep wear resistance high pertaining to toners adhering to the photo conductor and recovering toner at the cleaning means, and, in addition, suppression of adhesion and deposition of products due to charging, can be achieved. Achieving these preferred conditions depends on cleaning effect in removing each kind of adhesive from the toner. Removing adhesives and recovering toner is effective in the condition of the amount of adhesives in toners being in the middle density areas and the operating time being about 30 minutes (in the case that the diameter of the photo conductor is 30 mm and line speed is 125 mm/s). An amount of adhesives and an operating time more than those described above are not preferable, since burden on the cleaning means and the consumed quantity of toner-are increased. If a diameter of a photo conductor and/or line speed are different from those described above, the parameters can be appropriately adjusted to achieve operation conditions similar to those described above.

<Embodiments>

The present invention will be illustrated in detail by embodiments according to the present invention and comparisons below.

(Production of Toners)

Styrene acrylic resin (Haimar 75 produced by Sanyo Chemical): 85 parts

Carbon black (#44 produced by Mitsubishi Chemical): 8 parts

Azo dye including metal (Bontron S-34 produced by Orient Chemical): 2 parts

Carnauba wax (WA-03 produced by Serarika Noda): 5 parts

After the mixture having the above described composition was melted and kneaded by using heating roll at 140° C., the mixture was cooled and solidified. Subsequently, the mixture was milled by jet mill and classified to obtain toners having average diameter about 8.0 μm. The toners used in the following embodiments were obtained by mixing 0.7% hydrophobic silica R-972 (produced by Japan Aerosil) with 100 parts by weight of the toners obtained above by henshell mixer.

(Production of Carriers)

Coating liquid was prepared by mixing 100 g of toluene with 100 ng of the silicone resin (SR-2411 produced by Toray Dow Corning Silicone). The solution was applied to 1 kg of carrier heartwood (averaged particle diameter 60 μm Cu-Zn ferrite) by fluid bed method. Subsequently, they were dried for about 5 minutes, heated for 1 hour at 200° C., cooled, and sieved to produce the carriers according to the present invention. When the average diameter of particles is modified and next coated, it is necessary to adjust the amount of silicone resin converting the surface area to make the film thickness uniform.

(Production of a Developer)

The toners: 4 parts

The carriers: 96 parts

The toners and the carriers were mixed by tabler mixer.

(Production of Photo Conductor A)

Coating liquid for under coating layer, coating liquid for charge generating layer, and coating liquid for-charge transfer layer, which have the following compositions, in order, were applied on the aluminum cylinder (material:JIS1050) having 30 mm of the diameter and 340 mm of the length and dried to form an electro-photographic photo conductor consisting of 3.5 μm of under coating layer, 0.2 μm of charge generating layer, 22 μm of charge transfer layer and 2 μm of protecting layer.

<Coating Liquid for the Under Coating Layer>

Titanium dioxide powder: 400 parts

Melamine formaldehyde resin: 65 parts

Alkyd resin: 120 parts 2-butanone: 400 parts

<Coating Liquid for a Charge Generating Layer>

Bisazo dye having the following structure: 8 parts

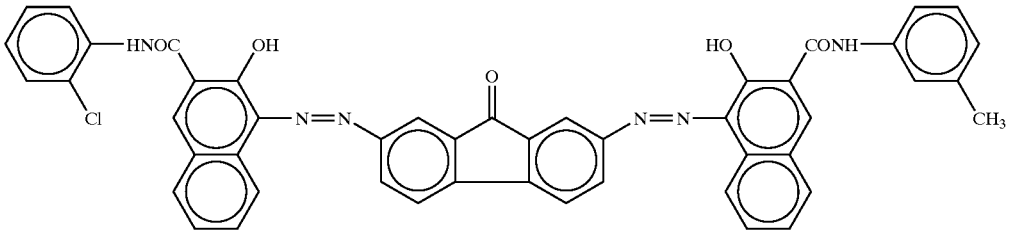

Trisazo dye having the following composition: 6 parts

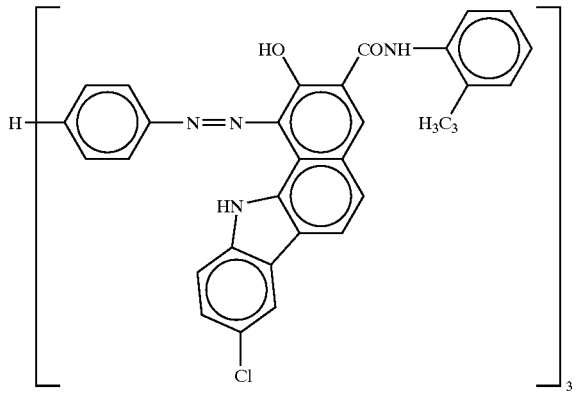

Polyvinyl butyral: 5 parts 2-butanone 200: parts

Cyclohexanone 400: parts

<Coating Liquid for the Charge Transfer Layer>

A-type polycarbonate: 10 parts

The charge transfer material represented by the following structural formula: 7 parts

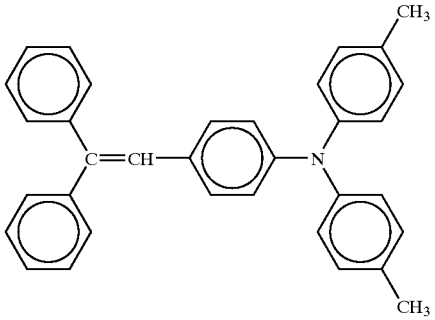

Tetrahydrofuran: 400 parts

Cyclohexanone: 150 parts

<Coating Liquid for the Protecting Layer>

A-type polycarbonate: 10 parts

The charge transfer material represented by the following structural formula: 8 parts

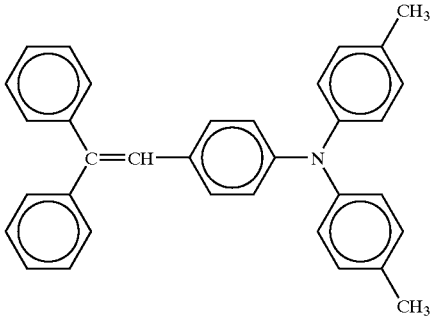

Alumina particles: 4 parts

Tetrahydrofuran: 400 parts

Cyclohexanone: 150 parts (Production of Photo Conductor B)

The photo conductor B was obtained by a method similar to the case of the photo conductor A except that alumina paricles were not used in the coating liquid for the protecting layer of the photo conductor A.

(Production of Photo Conductor C)

The photo conductor C was produced by a method similar to the case of the photo conductor A except that tetrafluoroethylene particles as an alternative to alumina particles were used in the coating liquid for the protecting layer of photo conductor A.

(Production of Photo Conductor D)

The photo conductor D was produced by a method similar to the case of the photo conductor A except that charge transfer material was not employed in the coating liquid for the protecting layer of photo conductor A.

(Production of Photo Conductor E)

The photo conductor E was produced by a method similar to the case of the photo conductor A except that the coating liquid for the protecting layer of photo conductor A was modified to one having the following composition.

<Coating Liquid for the Protecting Layer>

Polymeric charge transfer material having the following structural formula: 18 parts

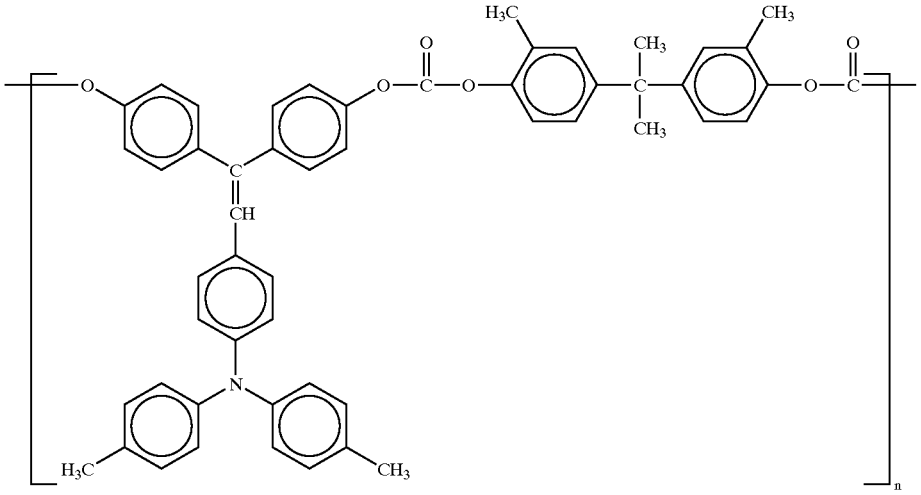

Alumina particles: 4 parts

Tetrahydrofuran: 400 parts

Cyclohexanone: 150 parts (Production of Photo Conductor F)

The photo conductor F was produced by a method similar to the case of the photo conductor A except that the coating liquid for the protecting layer of photo conductor A was modified to one having the following composition.

<Application Liquid for the Protecting Layer>

A-type polycarbonate: 10 parts

Charge transfer material having the following structural formula: 8 parts

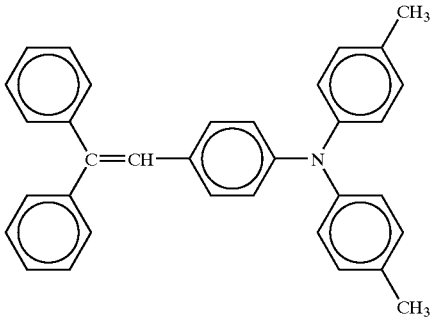

Alumina particles: 4 parts
Unsaturated polycarboxylic acid polymer solution: 0.1 pats (acid value:180 mgKOH/g, produced by BYK Chem)
Tetrahydrofuran: 400 parts
Cyclohexanone: 150 parts (Production of Photo Conductor G)

The photo conductor was produced by a method similar to the case of the photo conductor A except that the coating liquid for the charge generating layer of photo conductor A was modified to one having the following composition.

<Coating Liquid for Charge Generating Layer>

Figure 6:
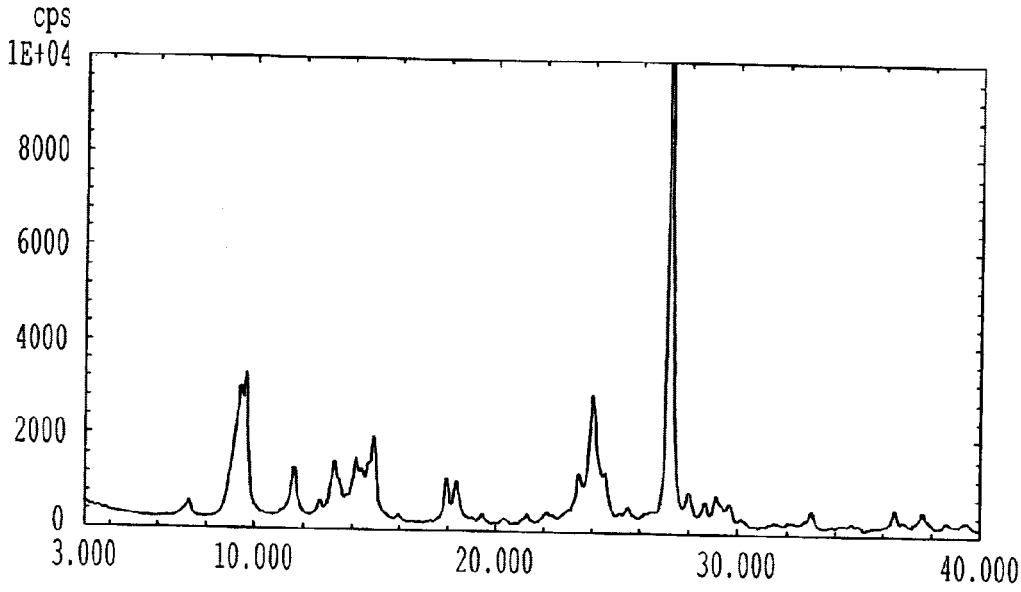
FIG. 6 shows a XD spectrum obtained with a phthalocyanine coating liquid for a charge generating layer according to the present invention.

Phthalocyanine in which the XD spectrum as shown in FIG. 6 was obtained: 3 parts
Polyvinyl butyral: 2 parts
2-butanone: 120 parts (Production of Photo Conductor H)

In the production example for the photo conductor G, the photo conductor H was formed by anodizing the conductive supporter, followed by laying a charge generating layer, a charge transfer layer, and a protecting layer, similar to the production example for photo conductor G, but without a laying under coating layer.

<Anodizing>

After mirror polishing, degreasing, and washing were applied to the surface of the supporter, the supporter was immersed into the electrolytic bath being 15% by volume of sulfuric acid at 20° C. of solution temperature and anodizing was applied to the supporter for 30 minutes at 15V of bath voltage. Furthermore, after the supporter was washed by water, a sealing treatment was applied in 7% nickel acetate solution (at 50° C.). After that, the supporter on which oxidation film on the anode of 6 μm was produced was obtained via washing by purified water.

(Evaluation)

Carrying performance of developer was evaluated by using the developer and the photo conductors produced as described above in the copying machine (Imagio MF250 produced by RICOH) in the condition shown in Table 1. The surface roughness (Rz) of the sleeve was adjusted by changing the processing condition. The development gap (Gp) and the doctor gap (Gd) between the controller and the developer supporter were adjusted by settings of the machine.

Next, after 30000 copies were continuously produced by using A4, 6% chart, the abrasion loss of the photo conductor was measured. The surface condition of carriers was observed by SEM, and peeling of the film and pollution with the toners were evaluated.

<A Method of Evaluating Carrying Performance>

Carrying performance: Five A3 black images were continuously produced and the uniformity of the black color in the fifth image was evaluated. If the developer was not carried well, the black color was diluted or the image having some lines was generated.

TABLE 1

| NO. | Particle diameter of carrier (D) (μm) | Surface roughness (Rz) (μm) | Used photo conductor |
|---|---|---|---|
| 1 | 50 | 10 | A |
| 2 | 50 | 10 | A |
| 3 | 50 | 10 | A |
| 4 | 50 | 10 | B |
| 5 | 50 | 10 | A |
| 6 | 50 | 10 | A |
| 7 | 50 | 30 | A |
| 8 | 50 | 25 | A |
| 9 | 60 | 20 | A |
| 10 | 50 | 5 | A |
| 11 | 50 | 50 | A |
| 12 | 50 | 10 | C |
| 13 | 50 | 10 | D |
| 14 | 50 | 10 | E |
| 15 | 50 | 10 | F |
| 16 | 50 | 10 | G |
| 17 | 50 | 10 | H |

| NO. | Gp (μm) | Gd (μm) | Gp/Gd | D/Rz | Development sleeve processing method |
|---|---|---|---|---|---|
| 1 | 0.7 | 0.7 | 1.0 | 5.0 | Sand blast |
| 2 | 0.7 | 1.0 | 0.7 | 5.0 | Sand blast |
| 3 | 0.7 | 1.0 | 0.7 | 5.0 | Grinding |
| 4 | 0.7 | 1.0 | 0.7 | 5.0 | Sand blast |
| 5 | 0.7 | 0.5 | 1.4 | 5.0 | Sand blast |
| 6 | 0.6 | 1.0 | 0.6 | 5.0 | Sand blast |
| 7 | 0.7 | 0.9 | 0.78 | 1.7 | Sand blast |
| 8 | 0.7 | 0.9 | 0.78 | 2.0 | Sand blast |
| 9 | 0.7 | 0.9 | 0.78 | 3.0 | Sand blast |
| 10 | 0.7 | 1.0 | 0.7 | 10.0 | Sand blast |
| 11 | 0.7 | 0.9 | 0.78 | 1.0 | Sand blast |
| 12 | 0.7 | 1.0 | 0.7 | 5.0 | Sand blast |
| 13 | 0.7 | 1.0 | 0.7 | 5.0 | Sand blast |
| 14 | 0.7 | 1.0 | 0.7 | 5.0 | Sand blast |
| 15 | 0.7 | 1.0 | 0.7 | 5.0 | Sand blast |
| 16 | 0.7 | 1.0 | 0.7 | 5.0 | Sand blast |
| 17 | 0.7 | 1.0 | 0.7 | 5.0 | Sand blast |

| No. | Developer carrying performance | Abrasion loss (μm) | Others |
|---|---|---|---|
| 1 | 2 to 3 | 0.5 | |
| 2 | 2 to 3 | 0.8 | |
| 3 | 3 | 0.8 | |
| 4 | 2 to 3 | 3.5 | Image density decrease |
| 5 | 2 | 0 | Photo conductor filming |
| 6 | 4 | 2.2 | Carriers adhesion |
| 7 | 2 | 1.3 | |
| 8 | 1 | 1.0 | |
| 9 | 1 | 0.5 | |
| 10 | 4 | 0 | Photo conductor filming |
| 11 | 2 | 2.5 | Carrier film peeling off |
| 12 | 2 to 3 | 1.1 | |
| 13 | 2 to 3 | 1.3 | Image density slight decrease |
| 14 | 2 to 3 | 0.4 | |
| 15 | 2 to 3 | 0.8 | Potential at exposed area decreasing comprared to comparison 2. Good filler dispersion in protecting layer. Good resolution. |
| 16 | 2 to 3 | 0.8 | Quantity of light could be reduced compared to comparison 2. Good resolution. (Very) good image density |
| 17 | 2 to 3 | 0.8 | Background was uniform compared to comparison 2. |

TABLE 1-continued

1: Very good
2: Good
3: Slightly bad
4: Bad

EXAMPLE NO. 18

The charger of the copying machine used in example 2 was modified and adapted to a scorotron charger as an alternative to the charged roller and 30000 copies were continuously produced similar to example 2. Herein, the electric potential at an unexposed area of the photo conductor was adjusted to be the same (−800V) as example 2.

EXAMPLE NO. 19

The charger of the copying machine used in example 2 was modified and adapted to the charged roller described below as an alternative to the contact charged roller and 30000 copies were continuously produced similar to example 2. Additive voltage was only a DC component similar to example 2.

<Charged Roller>

A closely arranged charged roller was formed by wrapping teflon tape having a thickness of 100 $\mu$m around areas (which are not image formation areas) of 0 to 5 mm measured from both edges of the charged roller used in example 2.

EXAMPLE NO. 20

Continuous copying was carried out similar to example 19, except that the charging condition of example 19 was changed as follows.

<Charging Condition>

The electric potential at an unexposed area: −800V −1.5V measured as peak to peak was applied as an AC component.

As described above, after 30000 copies were continuously produced in example 2, 18–20 half tone images were outputted under high temperature and high humidity (30° C., 90% RH) and the images were evaluated. The result of the evaluation is shown in table 2.

TABLE 2

| No. | Half tone image | Remark |
|---|---|---|
| 2 | Stains on image background resulting from dirty of charged roller was generated a little. | |
| 18 | Resolution was decreased a little. | In continuously copying, odor of ozone was strong. |
| 19 | Uneven density based on uneven charging was generated a little. | |
| 20 | Good | |

Although all of the trouble points in examples 2, 18, and 19 were not a troublesome level for actual use, the condition in example 20 was best.

EXAMPLE NO. 21

50000 copies were continuously produced in the condition of example 2.

EXAMPLE NO. 22

The copying machine used in example 21 was adapted to set the zinc stearate providing unit between the cleaning unit and the charging unit, wherein the structure of the zinc stearate providing unit was such that zinc stearate in the form of a bar was applied for 10 minutes every 100 copies. In terms of conditions, the endurance test was performed similar to example 21.

EXAMPLE NO. 23

The endurance test was performed similar to example 21 except that 0.15% zinc stearate powder was added to the toner provided to the development area.

EXAMPLE NO. 24

The endurance test was performed similar to example 23 except that in example 24, every time after producing 1000 papers, exposure to the electric potential of bright areas, the image not being formed process, toner development on the development area formed by the above exposure, and repetition of only recovering toner from the surface of the photo conductor by the cleaning unit were carried out for 20 minutes. After executing examples from 21 to 24, the output of the images was performed under the conditions of high temperature and high humidity. After the experiment was finished, the surfaces of the photo conductors were observed and the results are shown in Table.3.

TABLE 3

| No. | Image (after 50000 copies) | Others |
|---|---|---|
| 21 | Lack of image was generated a little. | Filming occurred a little. |
| 22 | Good | Filming did not occur. Nice image was obtained. |
| 23 | Good | Filming did not occur. Nice image was obtained. After run, as image was outputted at high temperature and high humidity, image blur occurred a little. |
| 24 | Good | Filming did not occur. Nice image was obtained. Image blur did not occur even at high temperature and high humidity. |

Under the conditions of example 21, as an endurance test was performed to 50000 copies, filming occurred on the surface of the photo conductor a little, and the lack of image occurred in association with the filming, however, the lack of image was not a troublesome level. On the other hand, filming could be prevented by providing zinc stearate on the surface of the photo conductor as in examples 22 and 23. Further, the image blur could be completely eliminated even at high temperature and high humidity (30° C. 90% RH) by cleaning the surface of the photo conductor as in example 24.

As it is clear that the present invention has excellent effects from the above detailed and concrete illustrations, according to the present invention, abrasion loss of a photo conductor could be suppressed by satisfying a relation Gp/Gd=0.7 to 1.0 and using a photo conductor having a protecting layer including a filler, a good balance with the carrying performance of a developer could be struck, the effects were enhanced by using a sand blasting process, and carrying performance could be improved by satisfying a relation $2 \leqq D/Rz \leqq 3$.

Elevation of electric potential at exposed areas originating from repeated use of a photo conductor can be suppressed and nice images can be obtained, by combining a charge transfer material or an organic compound having particular acid value with a protecting layer including a filler.

Adhesion of low resistant material to a surface of a photo conductor can be reduced by selecting an appropriate charging condition of a photo conductor in an image formation apparatus, and the effect of the present invention can be more significant.

The effect of the present invention can be more significant by including the means providing zinc stearate on a surface of a photo conductor.

The present invention is not limited to the specifically disclosed embodiments, and variations and modifications may be made without departing from the scope of the present invention.

The present application is based on Japanese priority applications No.2000-387939 filed on Dec. 20, 2000 and No.2001-380525 filed on Dec. 13, 2001, the entire contents of which are hereby incorporated by reference.

What is claimed is:

1. An image formation apparatus for developing an electrostatic latent image with a two-component developer comprising magnetic carriers and toners by using a development apparatus and a latent image supporter including a filler in an outermost layer thereof, the development apparatus having a developer supporter and a developer quantity controller, the developer supporter having an internally fixed magnetic body and rotating while supporting the developer on a surface thereof, and the developer quantity controller facing the magnetic body and comprising materials having rigidity or rigidity and magnetic properties, for controlling a quantity of the developer supported by the developer supporter by controlling a height of magnetic brushes, wherein a ratio of a development gap to a doctor gap between the developer supporter and the controller is from 0.7 to 1.0, a weight-averaged particle diameter of the developer carrier is from 20 to 60 $\mu$m, and a surface roughness of a development sleeve is from 10 to 30 $\mu$m.

2. The image formation apparatus as claimed in claim 1, wherein a surface of the development sleeve is processed by sand blasting.

3. The image formation apparatus as claimed in claim 1, wherein a ratio (D/Rz) of the weight-averaged particle diameter (D) of the developer carrier to surface roughness (Rz) of the development sleeve satisfies a relation $2 \leqq D/Rz \leqq 3$.

4. The image formation apparatus as claimed in claim 1, wherein the filler included in the outermost layer of the latent image supporter is formed by a metal oxide.

5. The image formation apparatus as claimed in claim 1, wherein the outermost layer of the latent image supporter includes a charge transfer material.

6. The image formation apparatus as claimed in claim 5, wherein the charge transfer material is a polymer having electron-donating groups.

7. The image formation apparatus as claimed in claim 1, wherein the outermost layer of the latent image supporter includes an organic compound of which acid value is from 10 to 40 (mgKOH/g).

8. The image formation apparatus as claimed in claim 1, wherein a charge generating material included in the latent image supporter is a titanylphthalocyanine having at least a maximum diffraction peak at 27.2° as a diffraction peak at Bragg angle 2θ (±0.2°) for characteristic X-ray of CuKα.

9. The image formation apparatus as claimed in claim 1, wherein the charge generating material included in the latent image supporter is an azo pigment represented by the following structural formula (A):

(A)

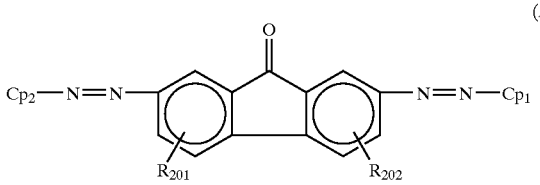

wherein $Cp_1$ and $Cp_2$ are coupler residues, which are identical or different from each other; wherein $R_{201}$ and $R_{202}$ are respectively selected from a group consisting of hydrogen atom, halogen atom, alkyl groups, alkoxy groups, and cyano group and are identical or different from each other; and $Cp_1$ and $Cp_2$ are represented by the following structural formula (B):

(B)

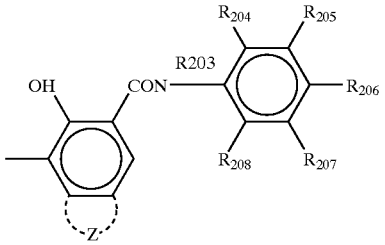

wherein $R_{203}$ is selected from a group consisting of hydrogen atom, alkyl groups such as methyl group and ethyl group, and aryl groups such as phenyl group; and $R_{204}$, $R_{205}$, $R_{206}$, $R_{207}$, and $R_{208}$ are respectively selected from a group consisting of hydrogen atom, nitro group, cyano group, halogen atom such as fluorine, chlorine, bromine, and iodine, trifluoromethyl group, alkyl groups such as methyl group and ethyl group, alkoxy groups such as methoxy group and ethoxy group, dialkylamino group, and hydroxyl group; and Z represents an atom group required for forming a substituted or non-substituted aromatic carbon ring or a substituted or non-substituted aromatic heterocyclic ring.

10. The image formation apparatus as claimed in claim 1, wherein a surface of a conductive supporter of the latent image supporter is anodized.

11. The image formation apparatus as claimed in claim 1, wherein a charger contacts or is closely arranged to the latent image supporter.

12. The image formation apparatus as claimed in claim 11, wherein a size of an air gap between the charger and the latent image supporter is equal to or less than 200 $\mu$m.

13. The image formation apparatus as claimed in claim 11, wherein an alternating current component is superposed on a direct current component in the charger to provide a charge to the latent image supporter.

14. The image formation apparatus as claimed in claim 1, wherein zinc stearate is applied on the latent image supporter.

15. The image formation apparatus as claimed in claim 14, wherein zinc stearate powder is included in the toner provided to a development area.

* * * * *